US007260865B2

(12) United States Patent
Lesley et al.

(10) Patent No.: US 7,260,865 B2
(45) Date of Patent: Aug. 28, 2007

(54) TWIST MOP

(75) Inventors: Paul M. Lesley, Chicago, IL (US); Uwe Dingert, Absteinach (DE); Miroslav Vuckivic, Skokie, IL (US)

(73) Assignee: Carl Freudenberg KG, Weinheim (DE)

( * ) Notice: Subject to any disclaimer, the term of this patent is extended or adjusted under 35 U.S.C. 154(b) by 442 days.

(21) Appl. No.: 10/660,939

(22) Filed: Sep. 12, 2003

(65) Prior Publication Data

US 2004/0128783 A1 Jul. 8, 2004

Related U.S. Application Data

(60) Provisional application No. 60/410,706, filed on Sep. 13, 2002.

(51) Int. Cl.
*A47L 13/142* (2006.01)

(52) U.S. Cl. ..... 15/120.1; 15/120.2

(58) Field of Classification Search ..... 15/120.1, 15/120.2

See application file for complete search history.

(56) References Cited

U.S. PATENT DOCUMENTS

| | | | | |
|---|---|---|---|---|
| 1,514,051 | A | 11/1924 | Jumonville | |
| 1,520,500 | A * | 12/1924 | Jumonville | 15/120.2 |
| 1,877,125 | A | 9/1932 | Evans | |
| 5,509,163 | A * | 4/1996 | Morad | 15/120.2 |
| D387,527 | S | 12/1997 | Specht | |
| 5,850,658 | A | 12/1998 | Specht | |
| 6,112,358 | A | 9/2000 | Specht | |
| 6,115,869 | A | 9/2000 | Libman | |
| 6,212,727 | B1 | 4/2001 | Bendor | |
| 6,212,728 | B1 | 4/2001 | Facca et al. | |
| 6,240,589 | B1 | 6/2001 | Specht | |
| 6,378,156 | B2 | 4/2002 | Specht | |
| 6,427,280 | B1 | 8/2002 | Specht | |
| 2004/0006836 | A1 * | 1/2004 | Dingert | 15/120.1 |

OTHER PUBLICATIONS http://www.wordnet-online.com/regular_polygon.shtml.*

* cited by examiner

*Primary Examiner*—Mark Spisich
(74) *Attorney, Agent, or Firm*—Leydig, Voit & Mayer, Ltd.

(57) ABSTRACT

Disclosed is a twist mop having a shaft, an operating member a rotatable with respect to the shaft, a mop element, and a device for releasably restricting relative rotation of the shaft and the operating member to one direction during the wringing operation. The device comprises an indexing surface disposed on the shaft at least over a portion of the shaft and at least one indexing arm which projects radially inwardly from the operating member to engage the indexing surface.

6 Claims, 23 Drawing Sheets

TWIST MOP

CROSS-REFERENCE TO RELATED PATENT APPLICATIONS

This patent application claims the benefit of priority to U.S. Provisional Application No. 60/410,706, filed Sep. 13, 2002, entitled "TWIST MOP," which is incorporated in its entirety herein by reference.

FIELD OF THE INVENTION

This invention relates in general to mops, and more particularly to a twist mop.

BACKGROUND OF THE INVENTION

Numerous mops and cleaning implements are known in the art. Conventional string mops comprise an elongate shaft having a mop element, which can include numerous strands of a liquid absorbent material at one end of the shaft, and an operator gripping portion at the other end of the shaft. Such mops require a wringer bucket or other wringing mechanism to expel liquid from the mop element. More recently, one trend in the mop art has been towards "self-wringing" mops, which are mops that themselves include a wringer or wringing mechanism of one type or another to enable a user to wring the mop without the need for a separate wringer bucket. For example, the prior art has provided roller sponge mops, butterfly sponge mops, shaft-type sponge mops, flat mops, and the like. In some commercially available mops, the mop element may be twisted around the shaft to thereby expel the liquid which has been absorbed during use of the mop from the mop element. Such mops are known in the art by the generic term "twist mops." Many manufacturers today sell numerous twist mop variations.

Some twist mops having a shaft, an operating member, which is axially displaceable and rotatable relative to the shaft, and a mop element, which can be wrung out by rotating the shaft elative to the operating member. It is desired to prevent the operating member from untwisting when one manually releases the operating member. The prior art has provided numerous efforts to address this problem.

U.S. Pat. No. 6,115,869, for example, discloses a twist mop which comprises a shaft, an operating member, which is an axially displaceable and rotatable relative to the shaft, and a mop head with cord-like cleaning elements which have their bottom ends fastened at the bottom end of the shaft and have their top ends fastened at the bottom end of the operating member. Each cleaning element forms a bight when the operating member is in a mopping position. This mop has a pawl device comprising a ring arranged on the shaft and from which resilient elements project in radially outwardly. The operating member is provided with ribs in the top region on its inner circumference. To wring the mop (i.e. to expel liquid from the mop element), the actuating sleeve is drawn axially away from the bottom mopping position. The resilient elements and the ribs together form a ratchet which permits rotation in the wringing direction but prevents rotation in the opposite direction. To return the mop element to a mopping position following the wringing operation, the operating member is advanced to thereby disengage the resilient elements and ribs.

A similar approach is provided by U.S. Pat. No. 6,212,728 in which another twist mop is described. This mop has a ratchet device which device comprises a pawl which projects radially inwardly from the actuating sleeve into a through-passage opening of the actuating sleeve and which engages a corresponding rib structure on the shaft.

It is a general object of the invention to provide a twist mop.

SUMMARY OF THE INVENTION

The invention provides a self-wringing mop having a shaft, an operating member, which is rotatable and axially movable with respect to the shaft, and a mop element connected to the shaft and operating member. Liquid may be expelled from the mop element by rotating the shaft relative to the operating member. The mop has a device for rotationally retaining the operating member relative to the shaft during the wringing operation. In accordance with the invention, the shaft is provided with an indexing surface, and the operating member is provided with an indexing arm which engages the surface and retains the operating arm with respect to the shaft to inhibit rotation of the operating member in one direction. Upon biasing of the operating member in a release direction contrary to the wringing direction, the arm forms a stop for the indexing surface. In contrast, upon biasing of the operating member in a wringing direction, the arm yields outwardly in relation to the indexing surface to permit rotation.

The twist mop according to the invention may be fabricated by a simple and cost-effective construction. Advantageously, the device can be produced easily and cost-effectively and, in particular, requires a small number of components. The shaft can have a polygonal cross-section in the indexing portion, thereby eliminating the need for any additional components such as rings with a groove-like or rib-like structure. A form fit of the index arm is not necessary. The mop can be made to avoid sharp-edged, outwardly projecting components which could constitute a hazard.

These and other features of the present invention will become apparent to one of ordinary skill in the art upon reading the detailed description, in conjunction with the accompanying drawings.

DETAILED DESCRIPTION OF PREFERRED EMBODIMENTS

The present invention is similar in some respects to the invention disclosed and claimed in German Patent Application No. 102 07 384.8, filed on Jan. 22, 2002, said application being incorporated herein in its entirety by this reference. The present invention is also associated with the invention disclosed in the U.S. Patent Application No. 60/410,705, entitled "Twist Mop," and filed on Sep. 13, 2002, and now expired, said application being incorporated herein in its entirety by this reference.

Figure 1:
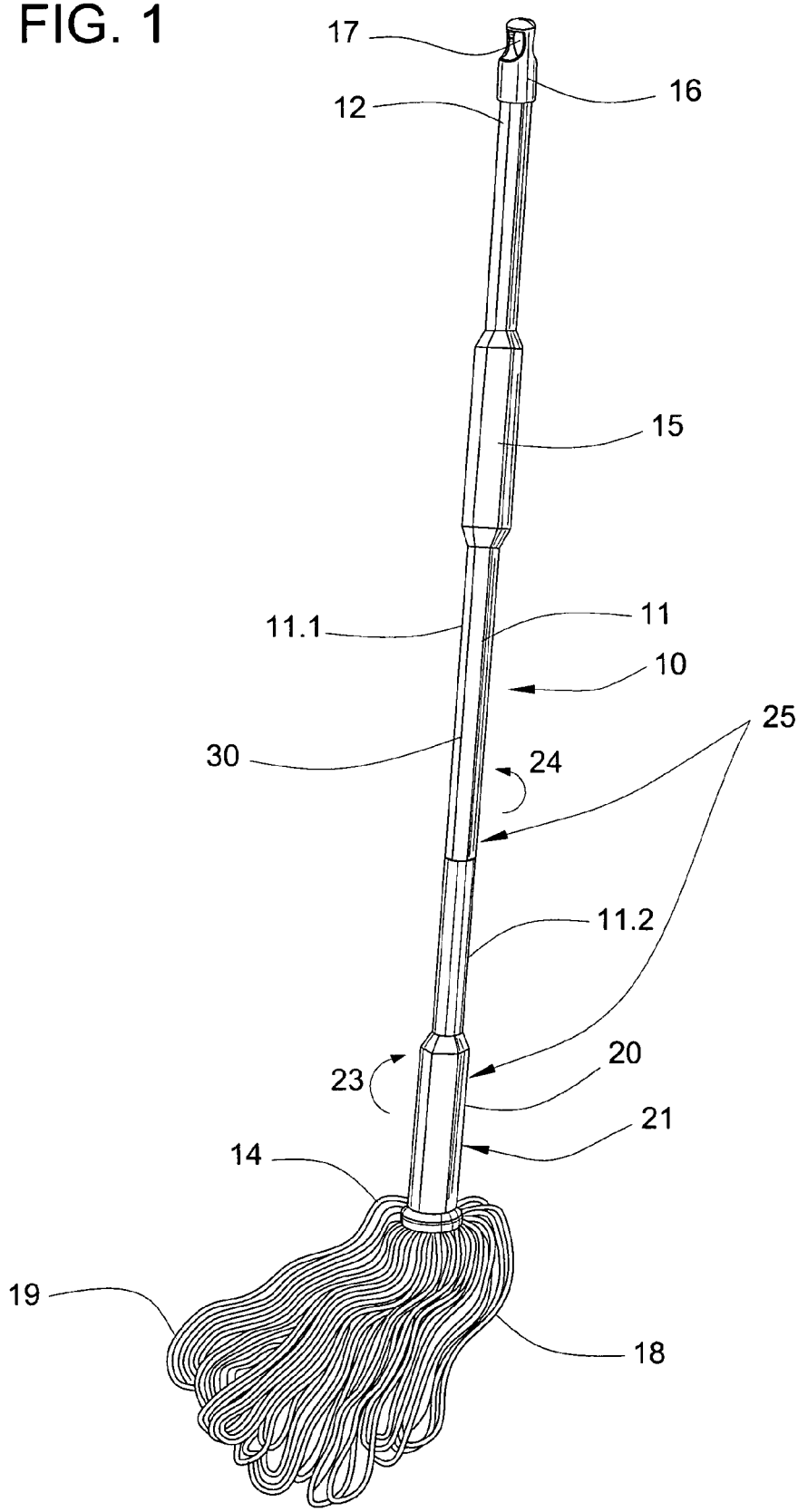
FIG. 1 is a perspective view of a twist mop according to the present invention.

Turning now to FIG. 1, an illustrative twist mop 10 includes an elongate shaft 11 having an operator end 12 and a cleaning end 14. The shaft 11 has a wringing section 11.1 and a mopping section 11.2. A grip element 15 is disposed near the operating end 12 of the shaft and is provided to facilitate handling the mop 10. The grip element 15 is preferably provided with ribs or edges in order to prevent a user's hand from slipping. For instance, the grip element may have a polygonal, preferably octagonal, external surface. A hanging loop 16 is disposed at the operator end 12 for storing the twist mop 10.

The twist mop 10 further includes a mop element 18, a portion of which can be and ordinarily is attached to the cleaning end 14 of the shaft 11. Another portion of the mop element 18 can be and ordinarily is connected to an operating member 20. The mop element may comprise any wringable liquid absorbing material. For example, in some embodiments, the mop element may comprise a plurality of liquid absorbent fiber ropes (sometimes referred to as "strings") or may comprise a plurality of absorbent material strips. In the embodiment illustrated, the mop element 18 comprises cord-like elements. The cord-like elements may be separate from one another, or may comprise a unitary interwoven body that resembles a plurality of ropes and that functions in a similar manner. One of the ends of the mop element is fastened releasably to the cleaning end 14 of the shaft 11 and the other end is fastened releasably to the operating member 20. The element may be fastened via appropriate ties or connectors (not shown). The twist mop 10 is shown in FIG. 1 in a mopping position. The operating member 20 is disposed adjacent the cleaning end 14 of the shaft 11 whereby the cord-like elements hang down in loops thus forming a plurality of bights 19. In the mopping position, and when the mop is oriented with the cleaning end 14 below the operator end 12, the bights 19 will hang below the clearing end 14 thereby permitting a user to apply liquid to a surface (such as a floor) or to remove liquid therefrom.

The operating member 20 is generally tubular and is axially movable and rotatable with respect to the shaft 11. Preferably, the operating member 20 is axially movable between a range of mopping positions, one of which is illustrated in FIG. 1, and a range of wringing positions, wherein the operating member is retracted axially from the cleaning end 14 of the shaft. The operating member 20 has a hand grip surface 21 to permit a user to adjust the axial position of the operating member 20.

Upon retraction of the operating member 20 it is possible to wring the mop element 18 by rotating the operating member 20 in a wringing direction 23 (indicated in FIGS. 1 and 2 via arrow 23) about the shaft 11. The mopping section 11.2 of the shaft 11 has a circular cross-section. When the operating member 20 is proximal the mopping section 11.2 of the shaft 11, rotation of the operating member 20 in a release direction (indicated in FIGS. 1 and 2 via arrow 24) about the shaft 11 will untwist the mop element 18. Indeed, in the mopping section 11.2, the operating member 20 can be rotated freely in both the wringing direction 23 and the release direction.

Figure 2:
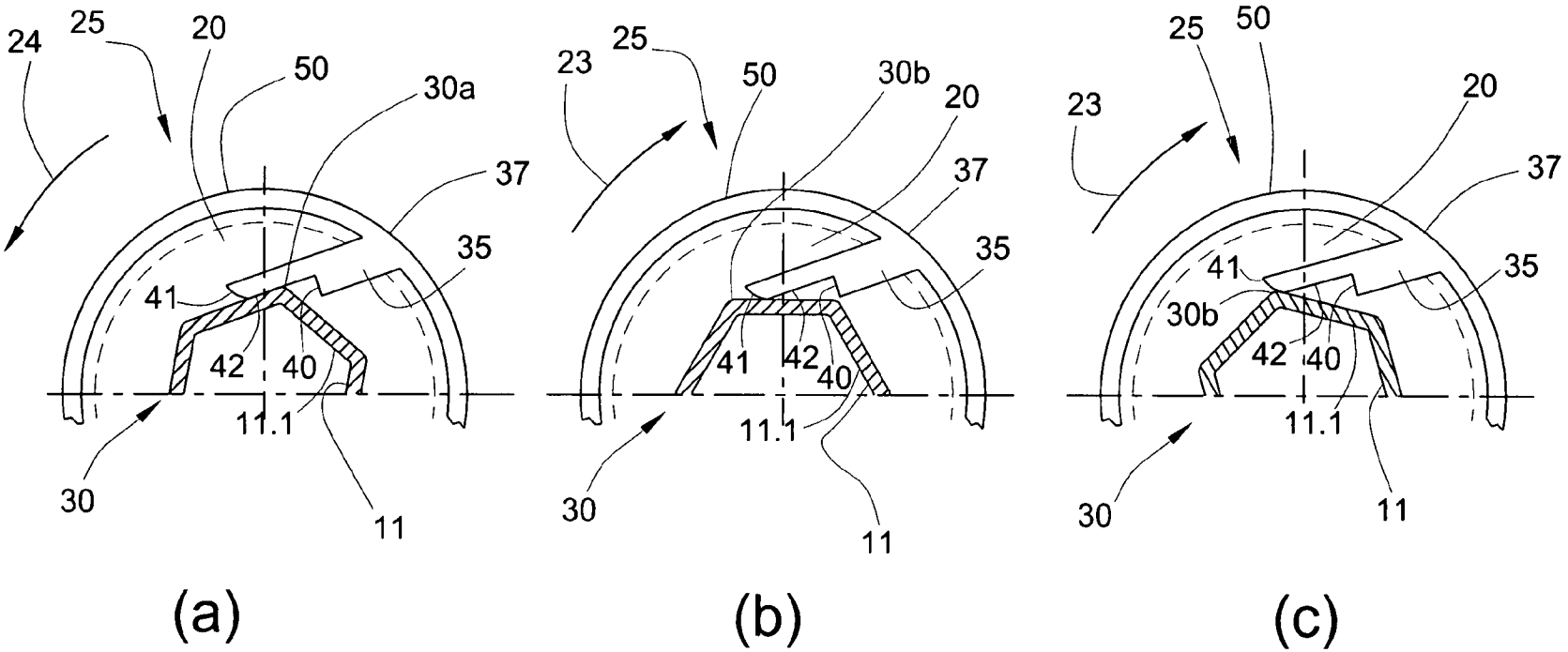
FIGS. 2*a-c* are partial cross-sectional views of the operating member and shaft of the twist mop shown in FIG. 1.

The twist mop 10 includes a device 25 for releasably restricting relative rotation of the shaft 11 and the operating member 20 in the release direction 24 when the operating member 20 is in a wringing position. The device comprises an indexing surface disposed on the shaft of the mop, which cooperates with at least one indexing arm disposed on the operating member. The device thus permits the operating member to move rotationally with respect to the shaft with incremental stops, whereby the device prevents the tension in the mop element caused by twisting of the mop element from "untwisting." In the illustrated embodiments, the wringing section 11.1 of the shaft has a polygonal, preferably octagonal, cross-section. With reference to FIG. 2, the operating member 20 is shown as retracted relative to the position of FIG. 1 and in a wringing position. In this position, the operating member 20 is disposed proximal to the indexing surface section of the wringing section 11.1 of the shaft 11. The operating member includes at least one indexing arm 35 which projects radially inwardly from the operating member 20 into the region of rotation of the indexing surface 30. Upon rotation in the wringing direction 23, the arm is biased outwardly in relation to the surface 30 thereby permitting rotation of the operating member in the wringing direction. Upon attempted rotation of the shaft 11 in the release direction 24, the arm exerts a stopping force on the wall of the operating member 20, thereby providing a stop for the indexing surface. Preferably, the components of the mop are sized such that the operating member may be advanced at least in several increments over the indexing surface before tension in the mop element overcomes the ability of the indexing arm to resist such tension.

To disengage the device 25, the operating member 20 is displaced axially toward the cleaning end 14 of the shaft 11 into the region of the mopping section 11.2 of the shaft 11. Torsional forces generated within the mop element will cause the mop element to return to an untwisted position with respect to the shaft, and the operating member will return to a mopping position. The untwisting to a mopping position may be assisted manually.

Figure 3:
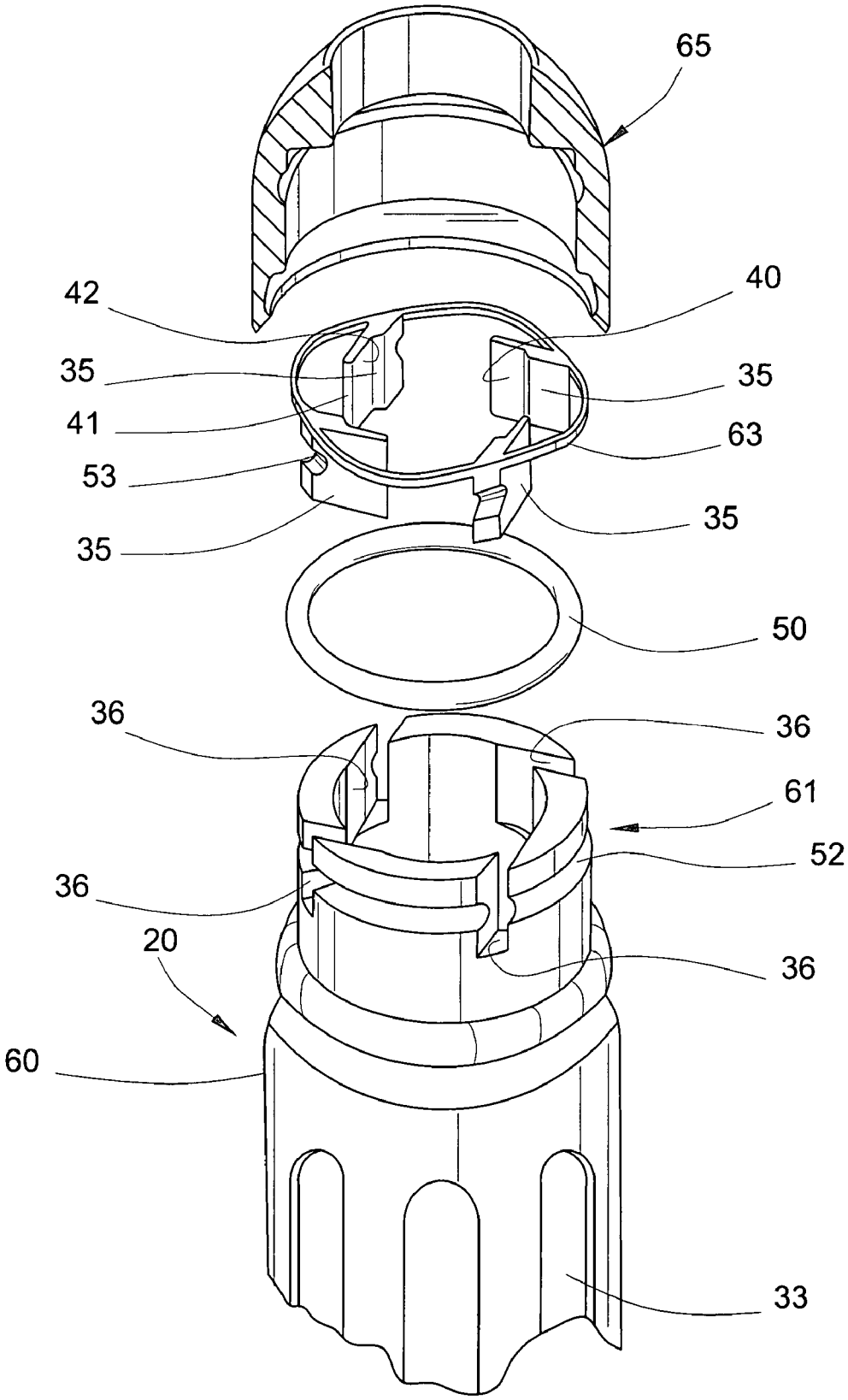
FIG. 3 is an exploded view of the operating member shown in FIG. 1.

As shown further in FIGS. 2 and 3, the indexing arm 35 is arranged such that it can be displaced tangentially outwardly. The arm 35 has a recessed channel 40 and contact-pressure surfaces 41, 42. The arm 35 projects inwardly into the interior of the operating member 20. It can be seen in FIG. 2*a* that, upon rotation of the shaft 11 in the release direction 24, the edge 30*a* of the indexing surface 30 of the arm butts against the contact-pressure surface 42 of the arm 35. The arm 35 is supported on the inner wall of the operating member 20. The force to which the contact-pressure surface 42 is subjected by the rotation of the shaft 11 is deflected by the surface 42 onto the inner wall 37 of the operating member 20.

Upon rotation in the wringing direction 23, as shown in FIGS. 2*b* and 2*c*, the outer circumferential surface of the shaft 11, which is adjacent to another edge 30*b*, of the indexing surface 30 acts on the contact-pressure surface 41 of the arm 35. As can be seen in FIG. 2*c*, the arm is displaced tangentially outwardly relative to the position shown in FIG. 2*b*.

As shown in FIG. 3, in this embodiment of the invention four indexing arms are provided. Each indexing arm 35 is in the form of a small vertically arranged plug, which can be inserted into a corresponding socket 36 in a cleaning end 60 of the operating member 20. The operating member 20 has an annular end element 61 at its cleaning end 60, wherein the slot-like sockets 36 are provided at the annular end element 61. The sockets 36 are distributed uniformly over the circumference of the end element 61. In a preferred embodiment of the invention, an O-ring 50 made of elastic material is provided, the O-ring being positioned in an annular groove 52, 53 formed by radially outward surfaces of the end element 61 and plug 25 respectively. The O-ring encircles the outer circumference of the operating member 20 and the arms 35, respectively. The arms 35 are distributed uniformly over the circumference of, and fastened on, an annular retainer 63. The retainer 63 has a larger circumference than the annular groove 52 to ensure that the arms 35 can move in the sockets 36. A covering cap 65 is provided to protect the arrangement from damage.

The embodiment illustrated in FIG. 3 has numerous production advantages. For example, the number of individual parts is small. Similarly, the risk of losing individual parts is small. Also, assembly is straightforward.

Figure 4:
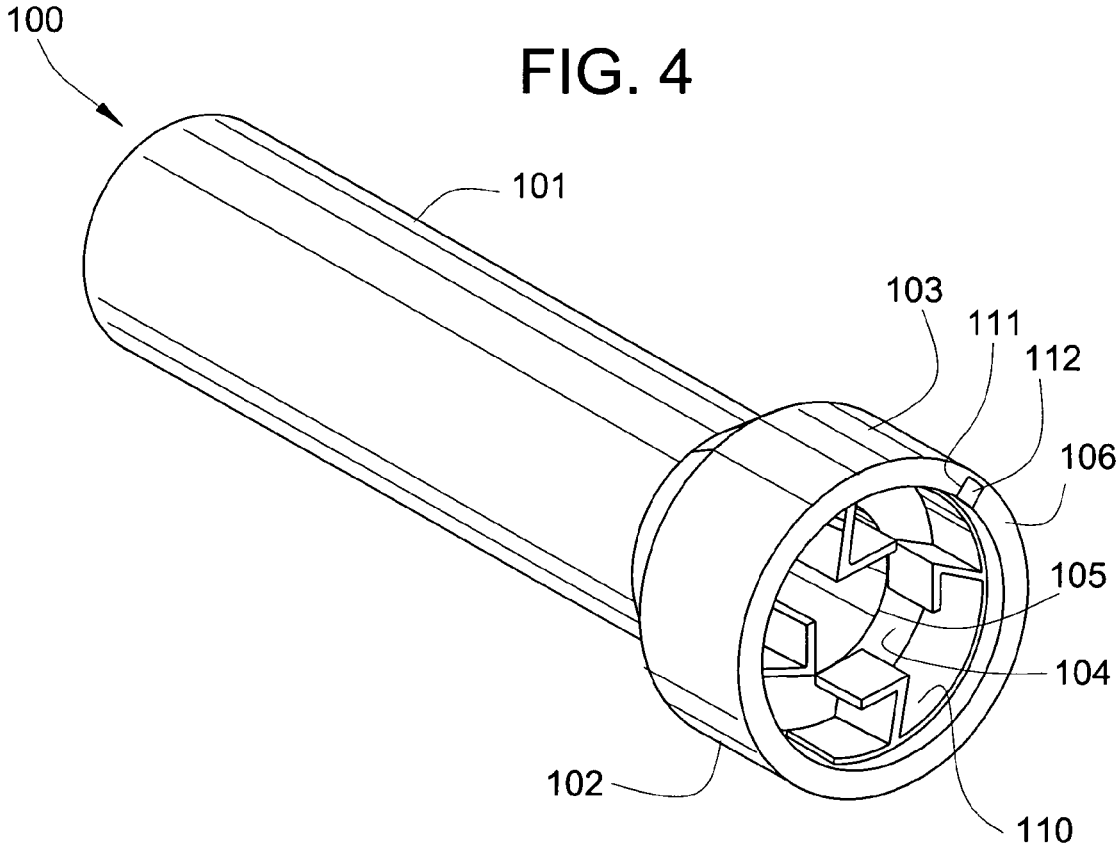
FIG. 4 is a perspective view of another embodiment of an operating member useful in connection with the present invention.

Referring to FIG. 4, an alternative operating member 100 includes a handgrip surface 101 to allow a user to adjust the axial position of the operating member 100 with respect to a shaft and to rotate the operating member. The operating member 100 includes a cleaning end 102 having an annular socket 103. The socket 103 includes a base portion 104 having a bore 105 therethrough to accommodate the shaft. The socket 103 also includes a generally cylindrical wall portion 106. An indexing device 110 is mounted to the operating member 100, being retained by the socket 103 and disposed therein. The wall portion 106 of the socket includes a notch 111 for retentively engaging a detent 112 of the device 110, whereby the engagement of the detent 112 and notch 111 ordinarily prevents the mount 110 from rotating relative to the operating member 100.

Figure 5:
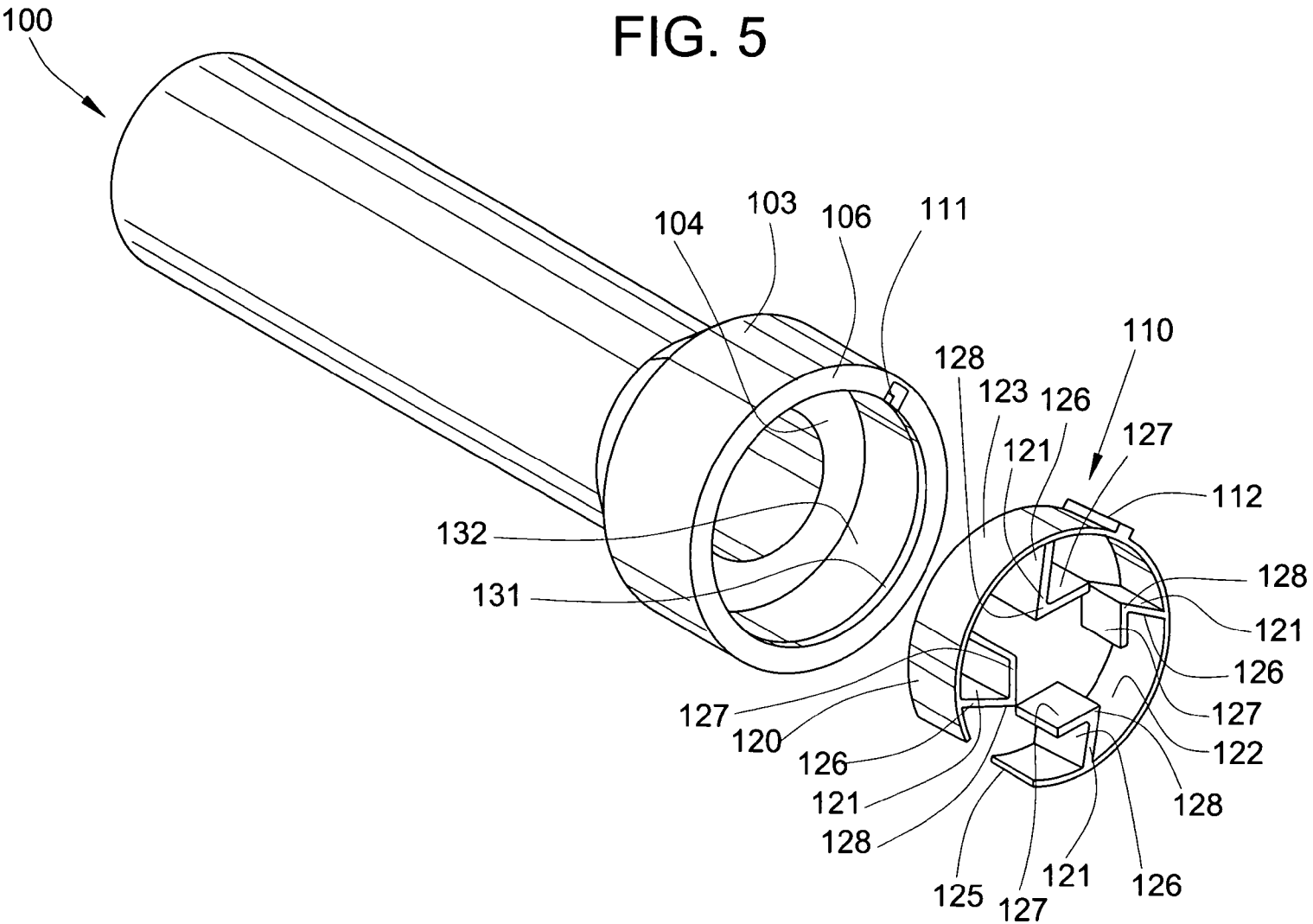
FIG. 5 is an exploded view of the operating member shown in FIG. 4.
Figure 6:
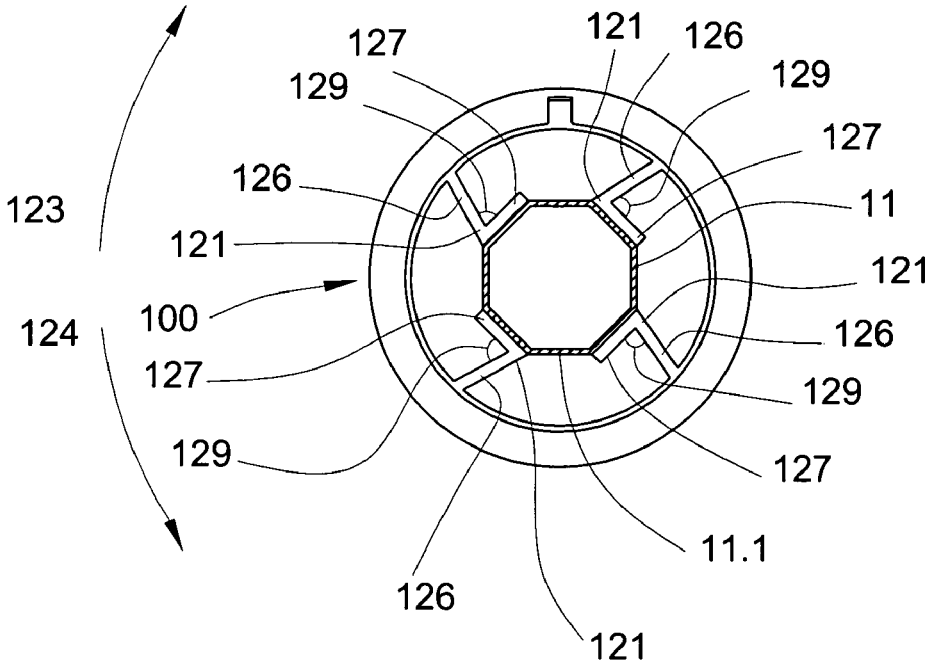
FIG. 6 is a cross-sectional view of the operating member of FIG. 4 disposed proximal the indexing surface section of a shaft and stopped at one incremental stop.

Referring to FIG. 5, the indexing device 110 includes a generally C-shaped, resiliently flexible support 120 and a plurality of indexing arms 121 projecting therefrom. The arms 121 project inwardly from an inner surface 122 of the support 120 while the detent 112 projects from an outer surface 123 of the support 120. Each arm 121 is generally L-shaped and includes a lever portion 126 and a bearing portion 127. The lever portion 126 extends from the mount 120 in a raked fashion at an oblique angle with respect to a tangent to the support. As shown in FIG. 6, each bearing portion 127 extends from the distal end 128 of the corresponding lever portion 126 to define an oblique angle 129 with respect to the lever 126. In the illustrative embodiment, the indexing device 110 includes four arms 121 disposed in a uniform, spaced relationship to each other about the mount 120. The bearing portions 127 of opposing arms are substantially parallel to each other. The levers 126 of each arm 121 are disposed such that each lever 126 can be biased outwardly, following the movement of the operating member 100 in the wringing direction 23.

Referring back to FIG. 5, the wall surface 106 of the socket 103 includes a lip 131 and an inner recess 132 extending around the circumference of the wall surface. The recess 132 is sized to accept the support 120 of the device 110. The lip 131 and the base 104 of the socket cooperate to prevent the support 120 from moving axially relative to the socket 103. The support 120 is formed of a material that is resilient. The support is sized such that, free of the socket 103, the other circumference of the socket 120 is slightly larger than the circumference of the wall surface 106 of the socket 103. The support 120 must be compressed slightly to be inserted into the socket 103 thereby creating a tensioning fit between the support 120 and socket 103. The fit of the support 120 within the recess 132 can aid in maintaining the detent 112 within the notch 11.

Referring to FIG. 6, the operating member 100 is shown stopped at an incremental rotational index stop relative to the shaft section 11.1 of the shaft 11. In this position, the bearing portions 127 of each arm 121 engage the indexing surface of the shaft. Upon attempting to rotate the operating member 100 in the release direction 124 opposite the wringing direction 123, the indexing surface of the shaft 11 engages the arms 121 with the lever portions 126 resisting rotation thereof. The raked position of the levers 126 allows the arms 121 to resist rotation in the direction 124 such that the operating member 100 is impeded from rotating in this direction. The resistance of the indexing device can be adjusted by adjusting the thickness of the bearing and lever portions, the angle between the bearing portion and lever portion, and the angle between the lever portion and a tangent to the support. In some embodiments, each bearing portion is made thinner at its free end to assist in starting rotation in the wringing direction.

Figure 7:
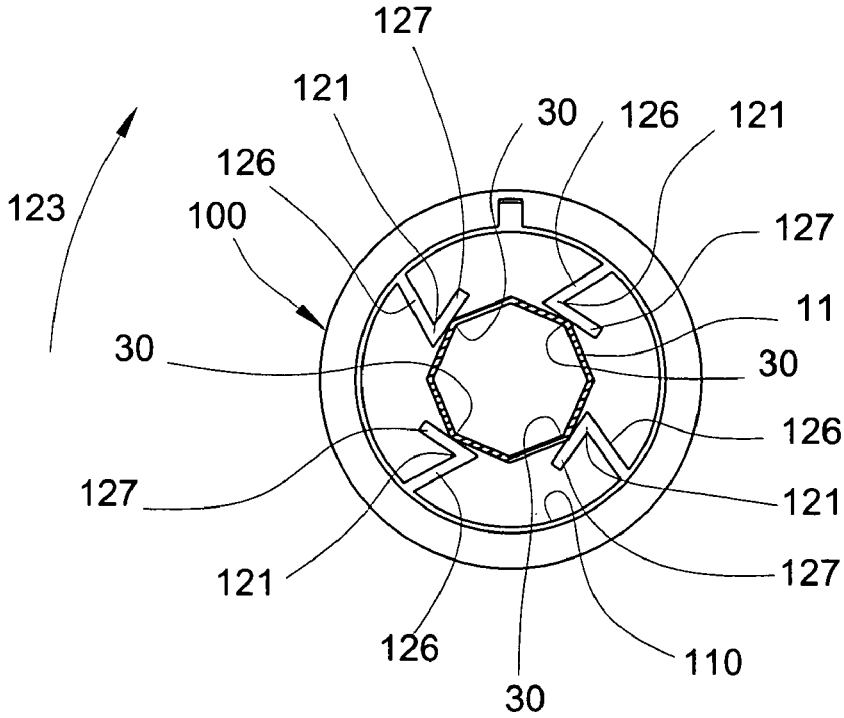
FIG. 7 is a cross-sectional view as in FIG. 6, illustrating the operating member relatively more advanced in a wringing direction.
Figure 8:
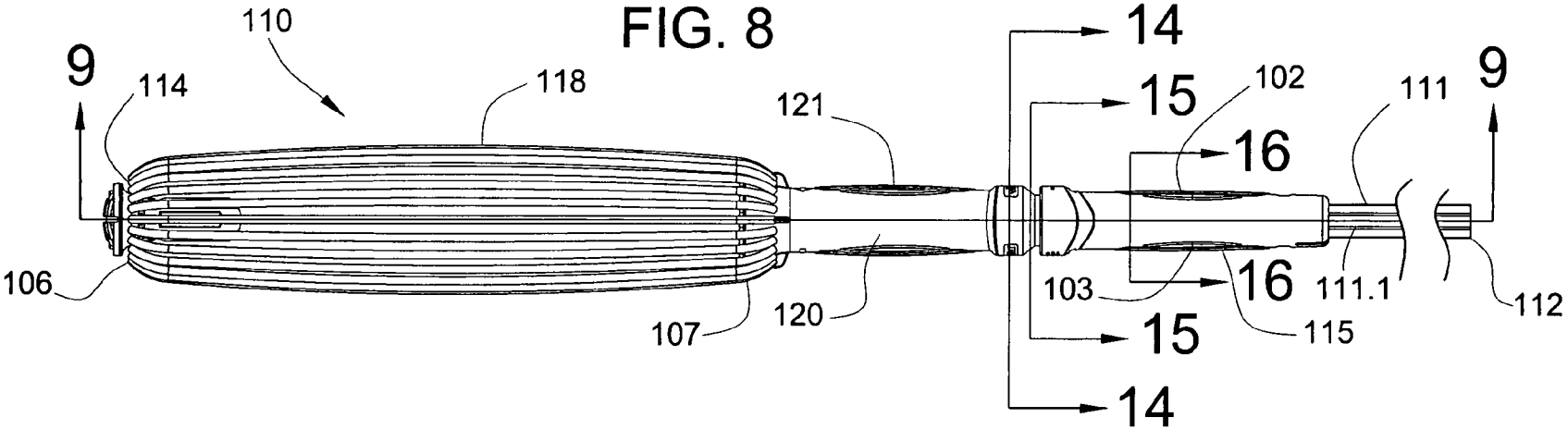
FIG. 8 is a front elevational view of another embodiment of a twist mop according to the present invention.
Figure 9:
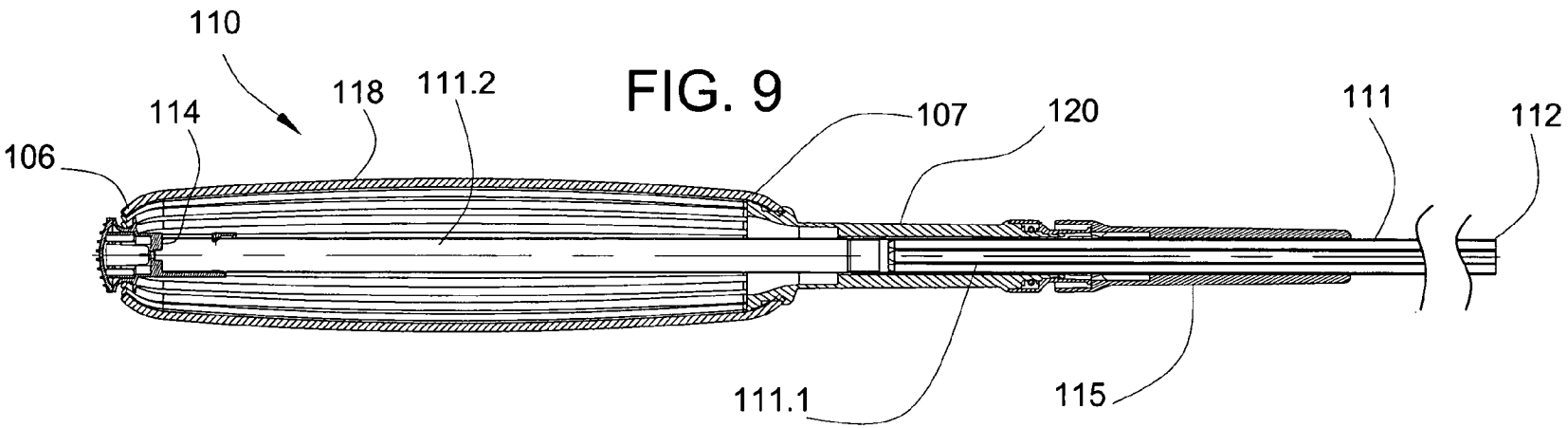
FIG. 9 is a cross-sectional view of the twist mop of FIG. 8 taken along line 9-9 in FIG. 8.
Figure 10:
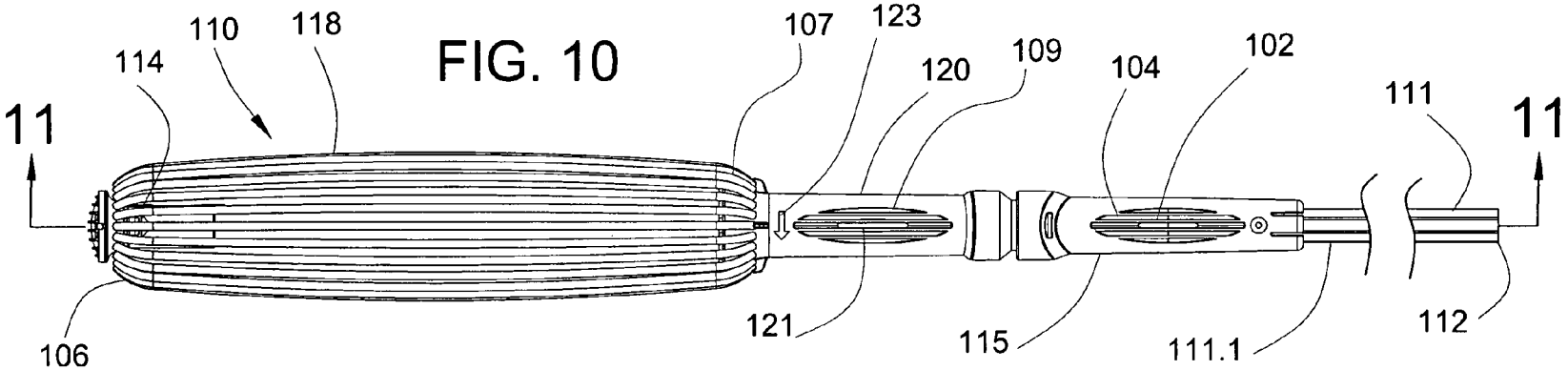
FIG. 10 is a side elevational view of the twist mop of FIG. 8.
Figure 11:
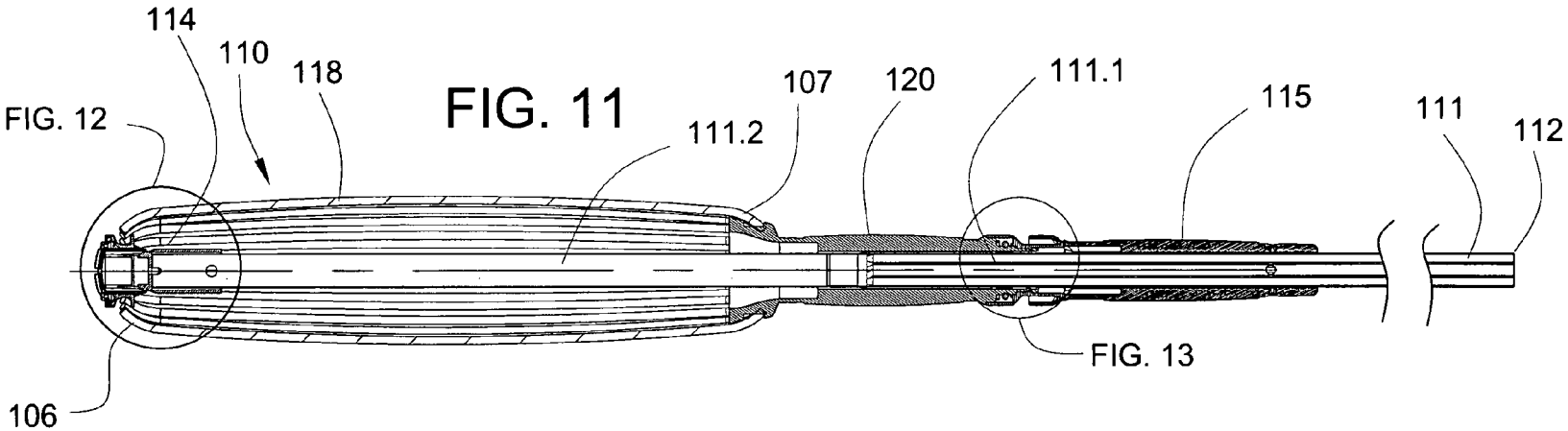
FIG. 11 is a cross-sectional view of the twist mop of FIG. 8 taken along line 11-11 in FIG. 10.

Referring to FIG. 7, upon rotation of the operating member 100 in the wringing direction 123, the outer circumferential surface of the shaft 11 engages the bearing portions 127 of the arm 121. These in turn exert a force on the lever portions 126, which deflect radically outwardly to allow the operating member 100 to rotate in the wringing direction 123. Upon further advancement in the wringing direction 123, the operating member will stop at a new incremental index stop. The operating member 100 and the device 110 preferably are similar in other respects to the embodiment illustrated in FIGS. 1-3.

It has proven advantageous for the shaft to have an octagonal cross-section in the region of the wringing section, because, in the case of the conventional shaft diameters of approximately 18-24 mm, the octagonal cross-section provides sufficiently large supporting surfaces for the indexing arms to engage. Even in the case of large tension forces generated upon twisting of the mop element, rotation in the opposite direction is prevented. However, in other embodiments the shaft can have different configurations. Likewise, one, two, three, four or more indexing arms may be provided.

Referring to FIGS. 8-49, another embodiment of a twist mop 110 according to the invention is shown. Referring to FIGS. 8-11, the twist mop 110 includes an elongate shaft 111 having an operator end 112 and a cleaning end 114. The shaft 111 has a wringing section 111.1 and a mopping section 111.2. The wringing section 111.1 of the shaft has a polygonal cross-section, in this case the polygon being an octagon. The mopping section 111.2 of the shaft 111 has a circular cross-section. A grip element 115 is disposed near the operating end 112 of the shaft and is provided to facilitate handling the mop 110. The grip element 115 includes a pair of gripping surfaces 102, 103 having ribs 104.

The twist mop 110 further includes a mop element 118. A first end 106 of the mop element 118 is fastened releasably to the cleaning end 114 of the shaft 111 and a second end 107 is fastened releasably to the operating member 120. The operating member 120 has a hand grip surface 121 to permit a user to adjust the axial position of the operating member 120. The hand grip surface includes a plurality of ribs 109 to facilitate the grasping thereof.

The operating member 120 is shown in a wringing position in FIGS. 8-11. The operating member is movable axially with respect to the shaft to dispose the cleaning element 118 in any of a range of mopping positions. The operating member 120 is releasably coupled with the grip element 115 in FIGS. 8-11. The operating member 120 is engaged with the grip element 115 such that it is releasably retained axially but free to rotate about the shaft 111 with respect to the grip element 115. Other wringing positions are possible. With the operating member 120 in one of the wringing positions, it is possible to wring the mop element 118 by rotating the operating member 120 with respect to the shaft 111 and the grip element 115 in a wringing direction 123 (indicated FIG. 10 via an arrow 123 on the operating member 120) about the shaft 111.

When the operating member 120 is proximal the mopping section 111.2 of the shaft 111, rotation of the operating member 120 in a release direction (opposite the wringing direction) about the shaft 111 will untwist the mop element 118. In the mopping section 111.2, the operating member 120 can be rotated freely in both the wringing direction and the release direction.

Figure 12:
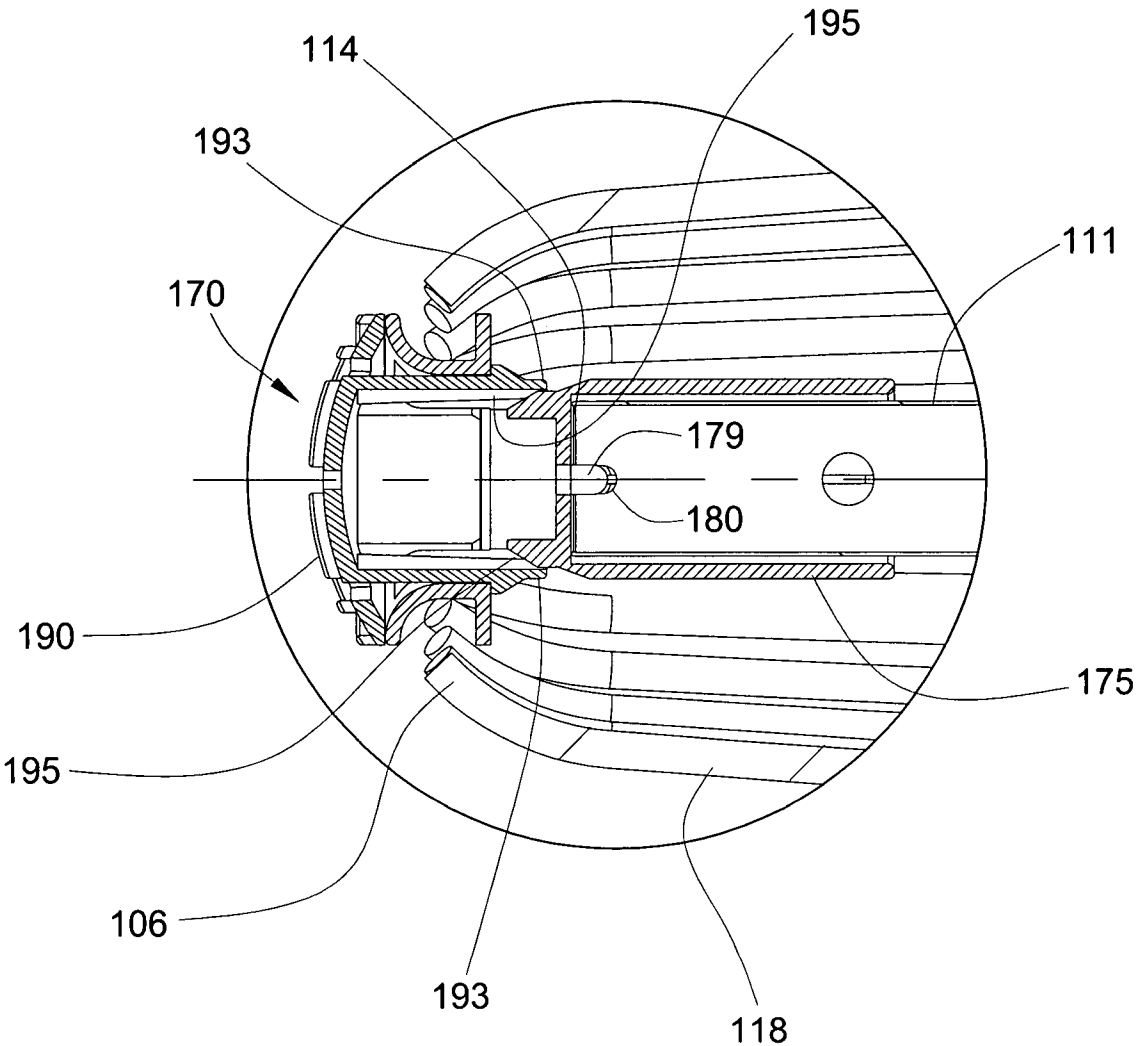
FIG. 12 is an enlarged detail view taken from FIG. 11 of a retainer assembly of the twist mop of FIG. 8.

Referring to FIG. 12, a mop retainer assembly 170 is shown. The mop retainer assembly 170 can releasably secure the mop element 118 to the cleaning end 114 of the shaft 111. The first end 106 of the mop element 118 can be secured to the retainer assembly 170 by any appropriate connector tie.

Figure 13:
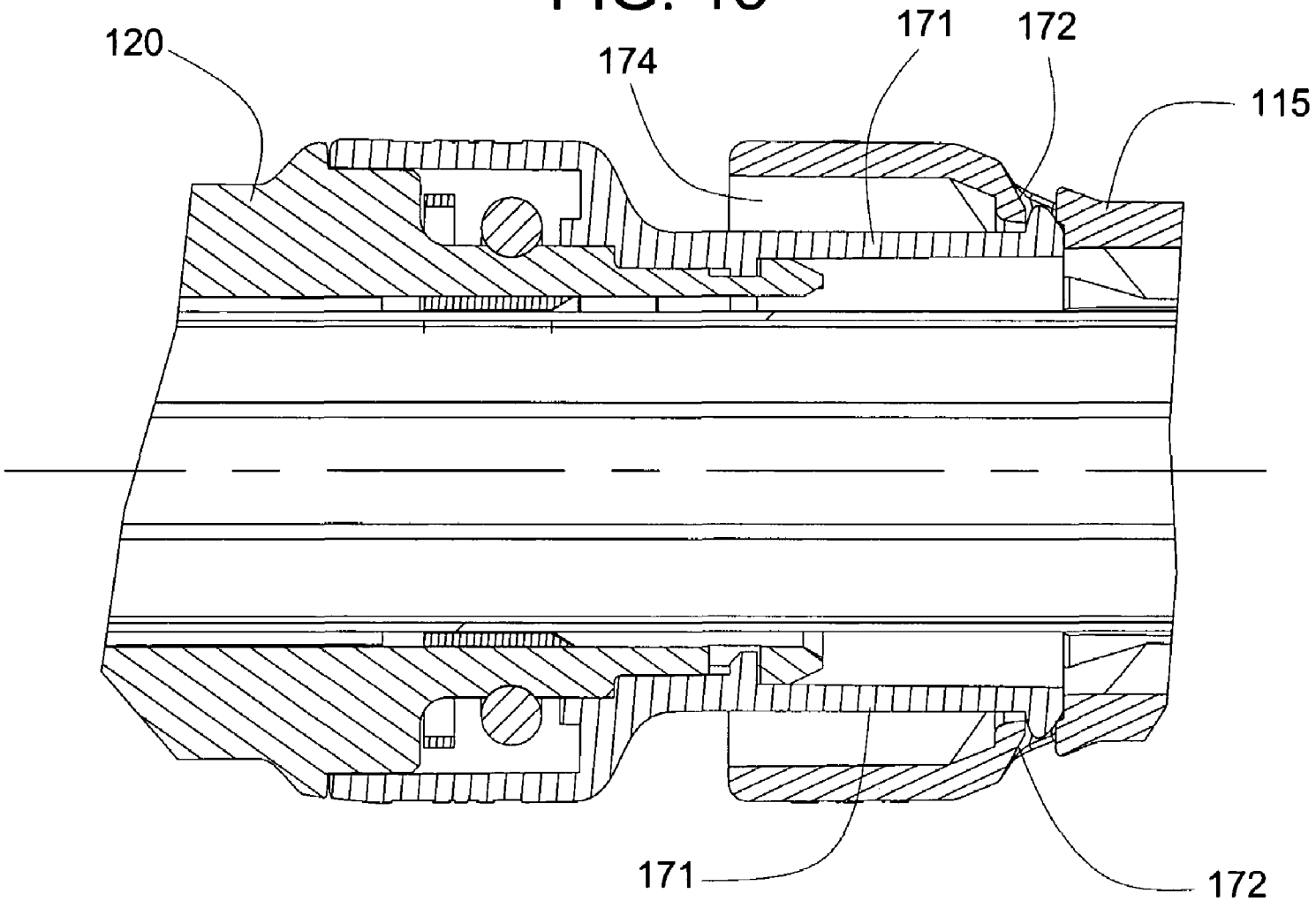
FIG. 13 is an enlarged detail view taken from FIG. 11 of a portion of a grip element and an operating member of the twist mop of FIG. 8.

Referring to FIG. 13, the operating member 120 is shown in a docked position. The operating member 120 includes a plurality of fingers 171 which can releasably engage a pair of slots 172 in the grip element 115. The grip element 115 can include a docking chamber 174 for receiving a portion of the operating member 120 to allow the fingers 171 to be disposed in engaging relationship with the slots 172. In some embodiments, there may be a different number of fingers than slots.

Figure 14:
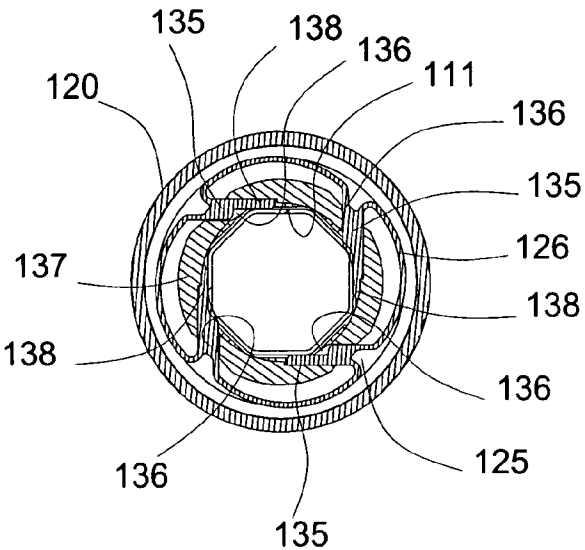
FIG. 14 is a cross-sectional view of the twist mop of FIG. 8 taken along line 14-14 in FIG. 8.
Figure 17:
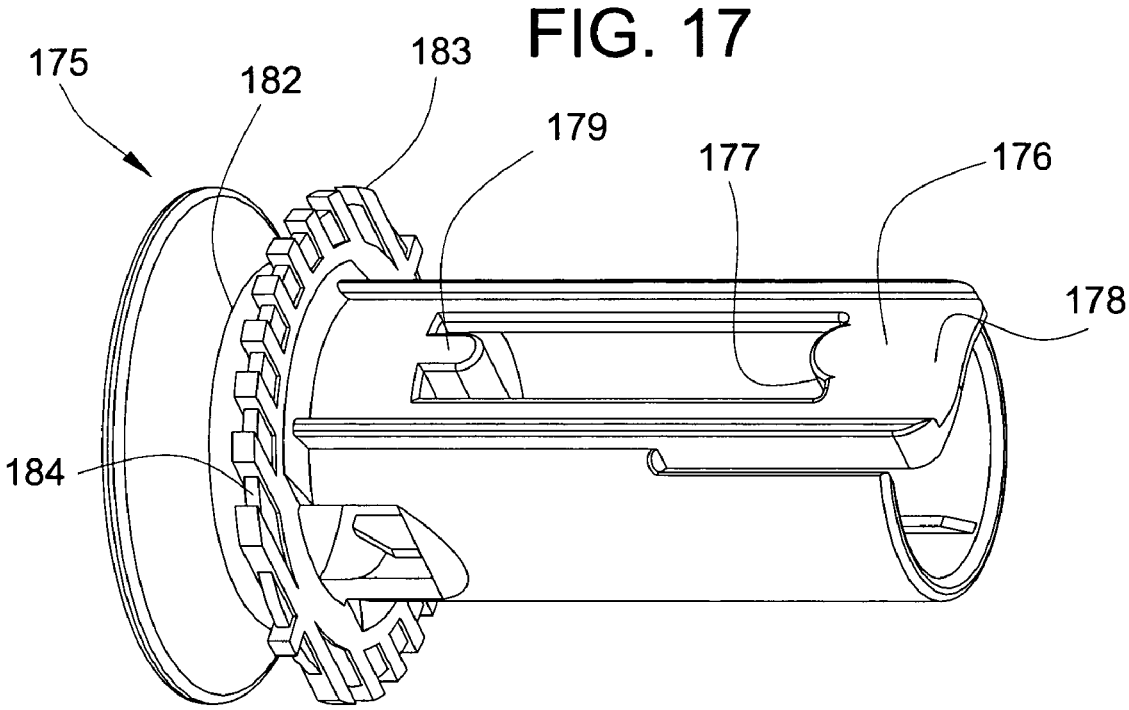
FIG. 17 is a perspective view of a first retainer member of the twist mop of FIG. 8.
Figure 18:
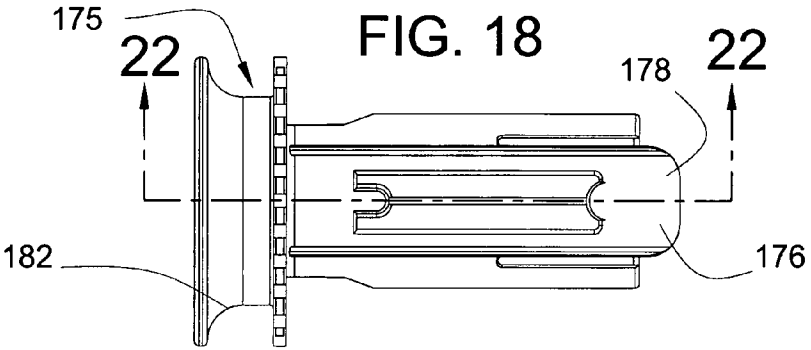
FIG. 18 is a front elevational view of the first retainer member of FIG. 17.
Figure 21:
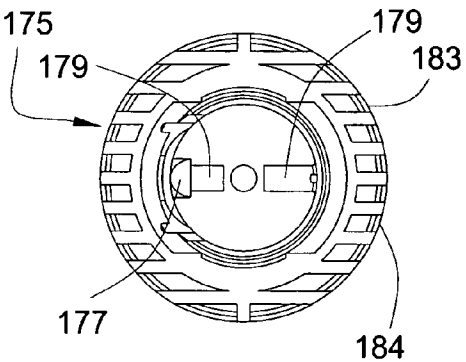
FIG. 21 is a top plan view of the first retainer member of FIG. 17.
Figure 19:
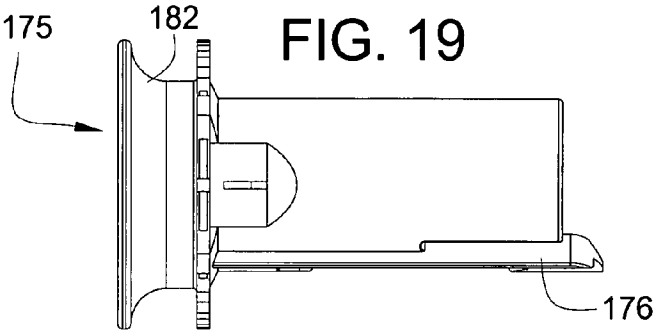
FIG. 19 is a side elevational view of the first retainer member of FIG. 17.
Figure 22:
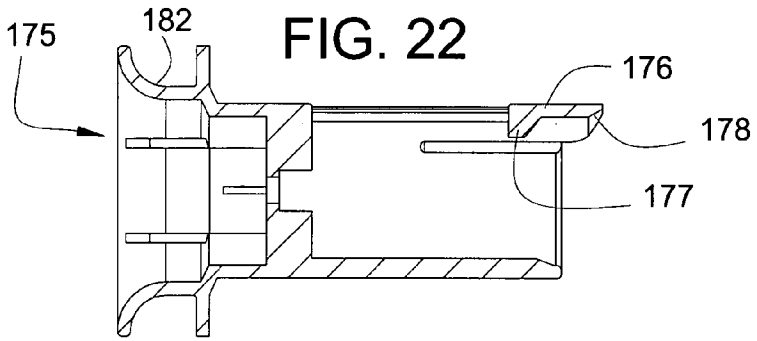
FIG. 22 is a cross-sectional view of the first retainer member of FIG. 17 taken along line 22-22 in FIG. 18.
Figure 20:
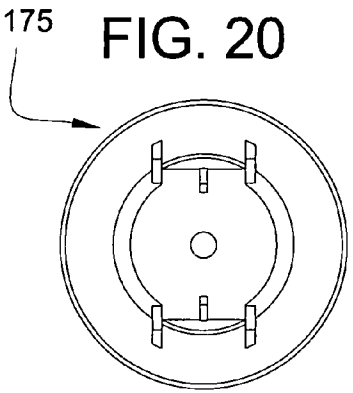
FIG. 20 is a bottom plan view of the first retainer member of FIG. 17.
Figure 23:
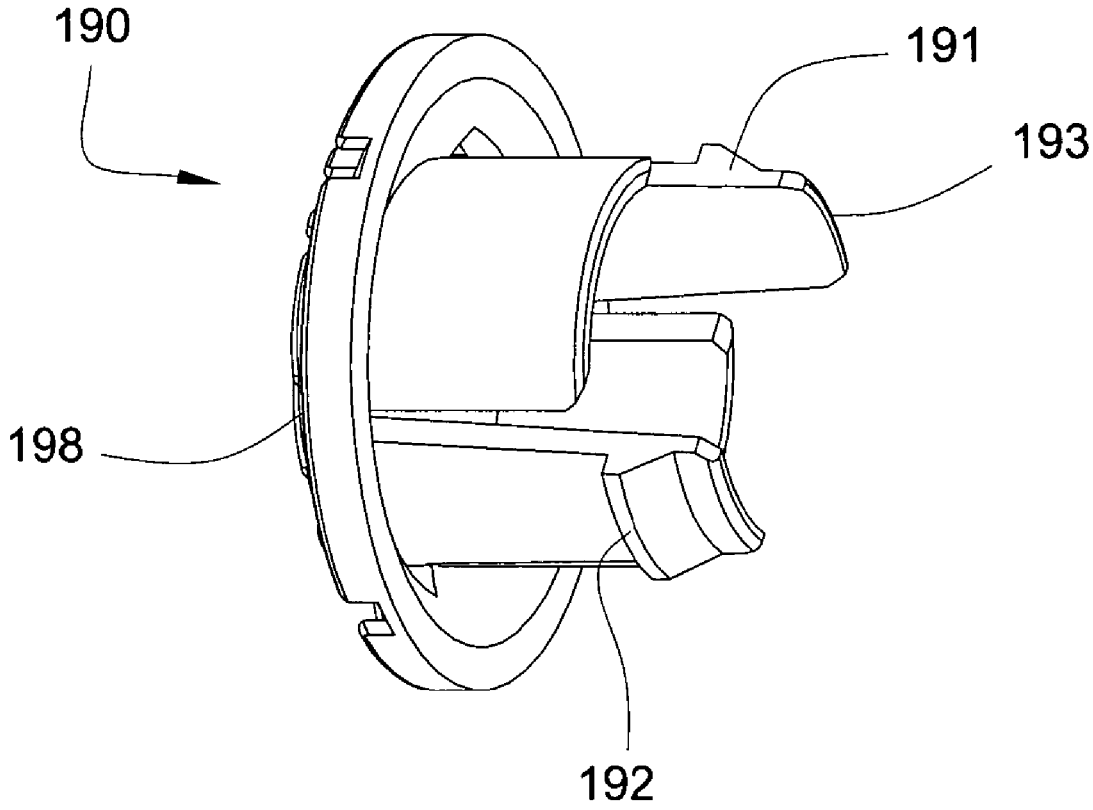
FIG. 23 is a perspective view of a second retainer member of the twist mop of FIG. 8.
Figure 24:
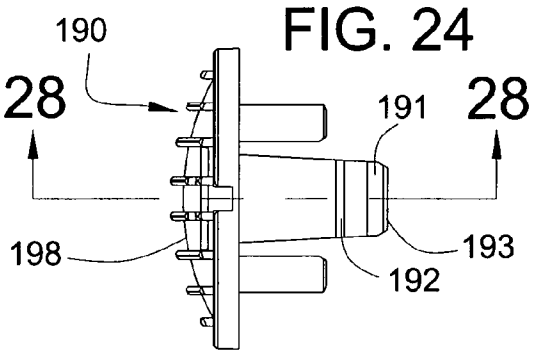
FIG. 24 is a front elevational view of the second retainer member of FIG. 23.
Figure 25:
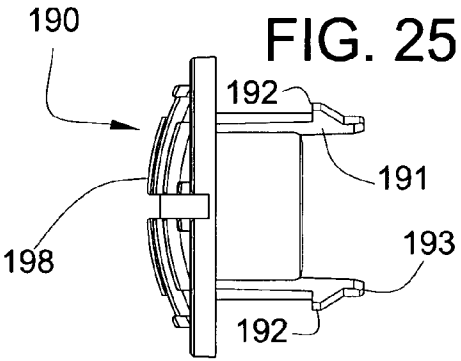
FIG. 25 is a side elevational view of the second retainer member of FIG. 23.
Figure 28:
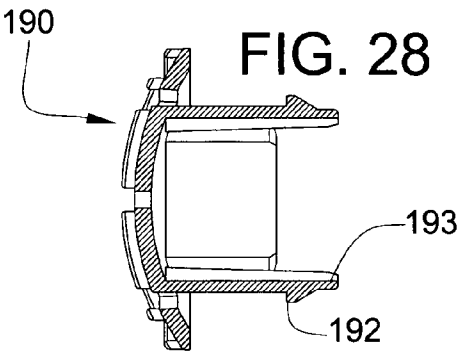
FIG. 28 is a cross-sectional view of the second retainer member of FIG. 23 taken along line 28-28 in FIG. 24.
Figure 26:
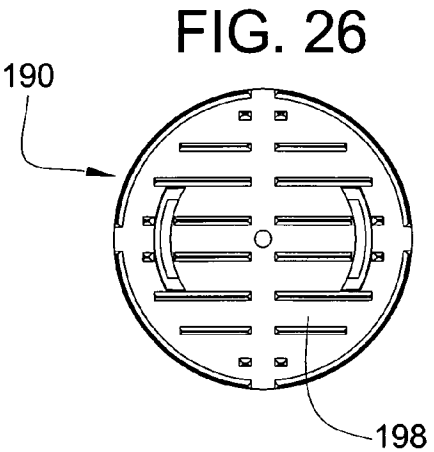
FIG. 26 is a bottom plan view of the second retainer member of FIG. 23.
Figure 27:
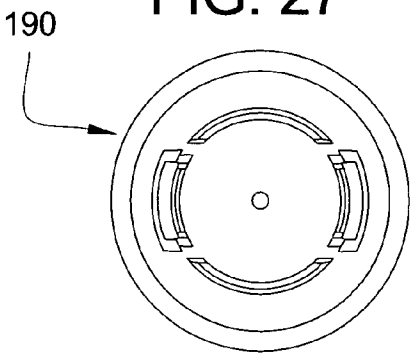
FIG. 27 is a top plan view of the second retainer member of FIG. 23.
Figure 29:
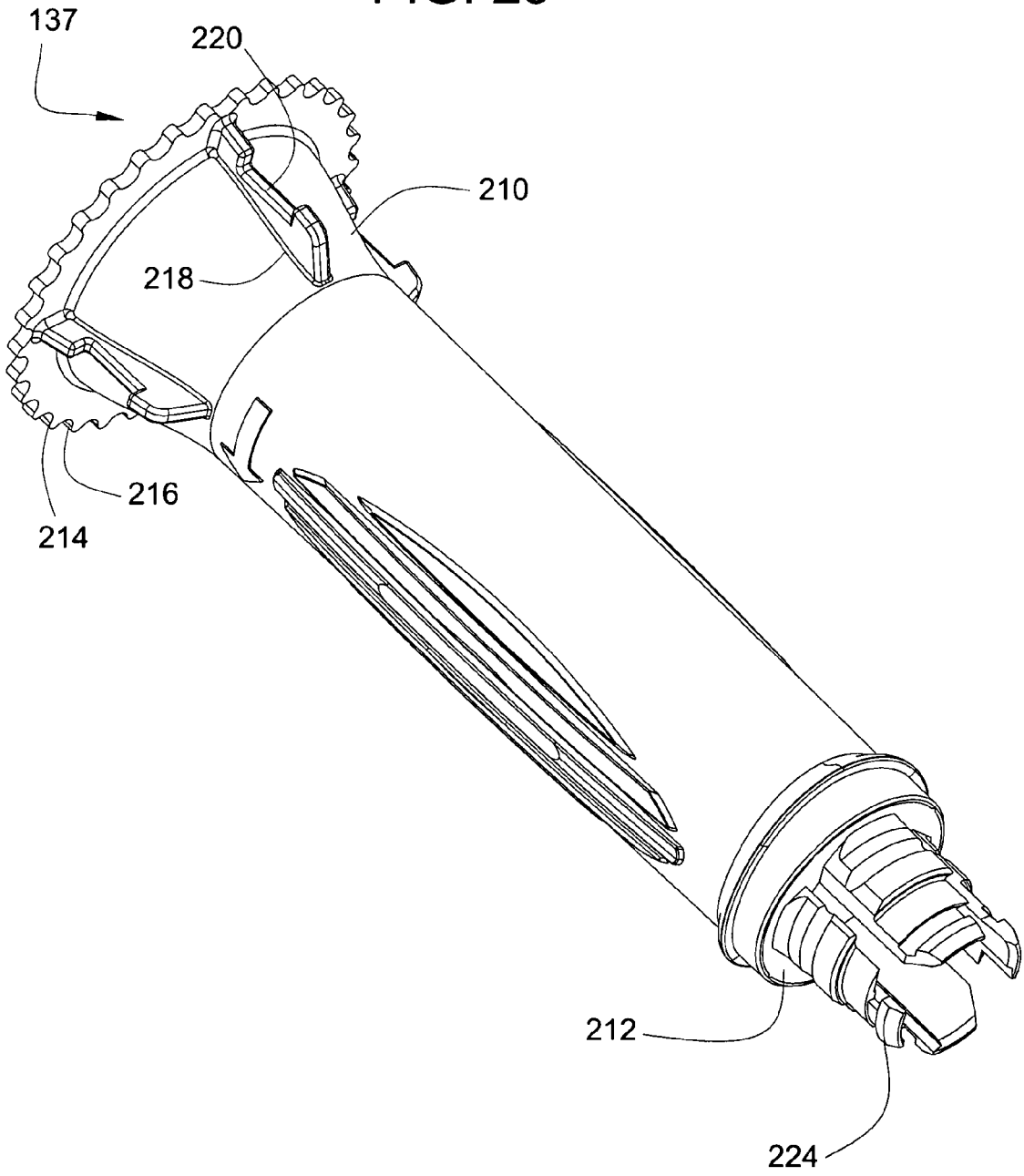
FIG. 29 is a perspective view of a handle portion of the operating member of the twist mop of FIG. 8.
Figure 33:
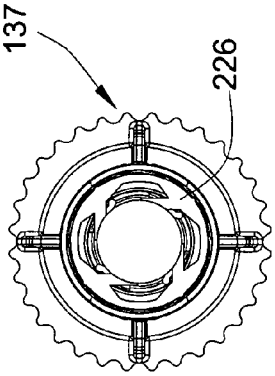
FIG. 33 is a top plan view of the handle portion of FIG. 29.
Figure 34:
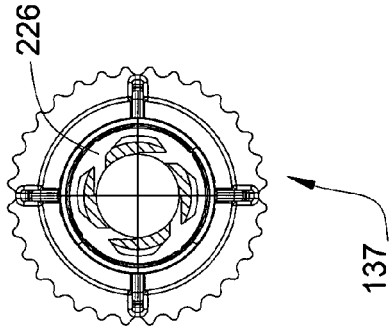
FIG. 34 is a cross-sectional view of the handle portion of FIG. 29 taken along line 34-34 in FIG. 30.
Figure 31:
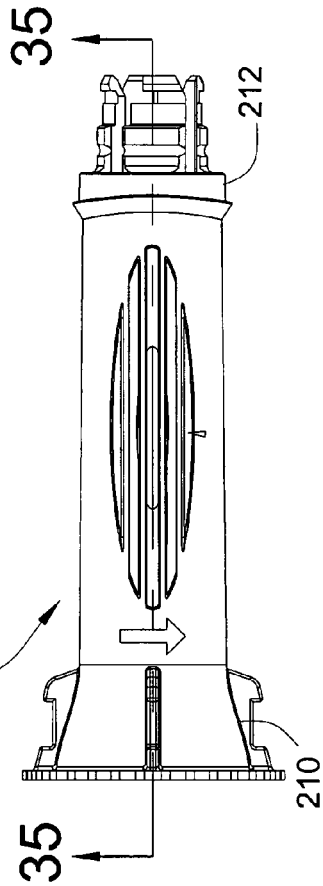
FIG. 31 is a side elevational view of the handle portion of FIG. 29.
Figure 30:
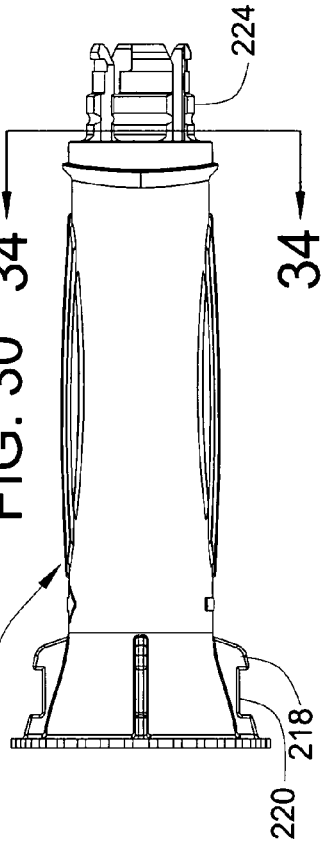
FIG. 30 is a front elevational view of the handle portion of FIG. 29.
Figure 35:
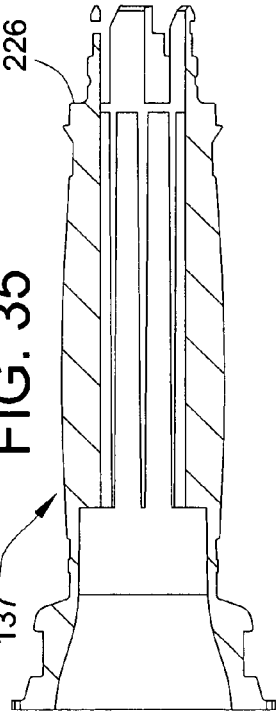
FIG. 35 is a cross-sectional view of handle portion of FIG. 29 taken along line 35-35 in FIG. 31.
Figure 32:
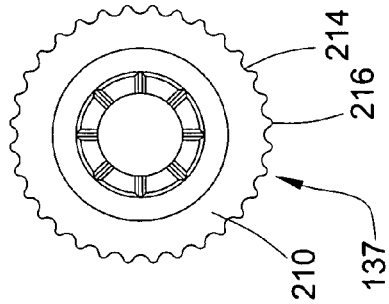
FIG. 32 is a bottom plan view of the handle portion of FIG. 29.

Referring to FIG. 14, the operating member 120 can include a device 125 for releasably restricting rotation of the operating member 120 in the release direction with respect to the shaft 111. The device can include an indexing member 126 having a plurality of indexing arms 135. Each indexing arm 135 can extend through an opening 136 defined by a handle portion 137 of the operating member 120. The indexing member 126 can be an integral piece but need not be. The indexing arms 135 can extend inwardly toward each other such that distal ends 138 of the indexing arms are in proximal relation to the shaft 111.

Figure 15:
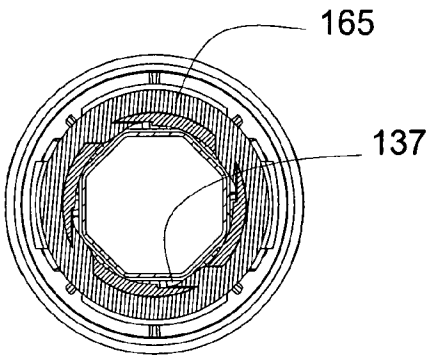
FIG. 15 is a cross-sectional view of the twist mop of FIG. 8 taken along line 15-15 in FIG. 8.

Referring to FIG. 15, a covering cap 165 is removably coupled to the handle portion 137 of the operating member. The covering cap 165 can act to axially retain the indexing member 126 while allowing the indexing member 126 to move radially outwardly or inwardly.

Figure 16:
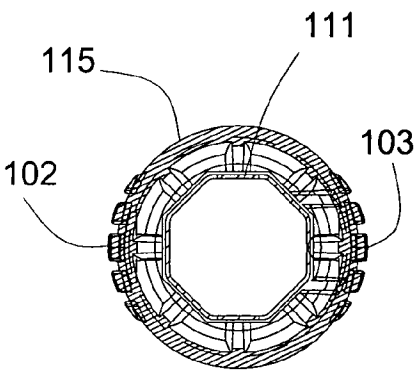
FIG. 16 is a cross-sectional view of the twist mop of FIG. 8 taken along line 16-16 in FIG. 8.

Referring to FIG. 16, the grip element 115 is axially and rotationally fixed with respect to the shaft 111. The grip surfaces 102, 103 extend from opposing sides of the grip element 115.

Referring to FIGS. 17-22, a first retaining member 175 of the mop retaining assembly 170 is shown. The first retaining member 175 can be releasably engaged with the cleaning end 114 of the shaft 111, as shown in FIG. 12. The first retaining member 175 can include a resiliently flexible latch 176 for engagement with the shaft 111. A post 177 extending from a free end 178 of the latch 176 can be disposed in a hole of the shaft 111 to retain the first retaining member 175 axially with respect to the shaft 111. A protrusion 179 can engage one or more grooves 180 formed in the shaft 111 to prevent the first retaining member from rotating with respect to the shaft 111. The first retaining member includes an area 182 for receiving a connector or tie useful in connection with securing the first end of the mop element 118 thereto. A plurality of projections 183 with notches 184 therebetween can project radially around the first retaining assembly to facilitate the connection of the mop element 118 to the first retaining member 175.

Referring to FIGS. 23-28, a second retaining assembly 190 of the mop retaining assembly 170 is shown. The second retaining assembly 190 can be coupled to the first retaining assembly 175 via a plurality of latches 191 each having a shoulder 192 thereon adjacent a free end 193. As shown in FIG. 12, the free ends 193 of the second retaining member 190 can extend through openings 195 of the first retaining member 175 such that the shoulders 192 retain the first and second retaining members 175, 190 together. Referring to FIGS. 23-26, the second retaining member 190 can include an end 198 with a convex surface. The end 198 can receive any suitable material, such as one that is relatively more abrasive than the material of the mop element 118. The abrasive material can be secured to the second retaining member 190 by any suitable technique. In some embodiments, the material can be a felt or a felt-like material.

Referring to FIGS. 29-35, the handle portion 137 of the operating member 120 is shown. The handle portion 137 can include a cleaning end 210 and an operator end 212. A plurality of projections 214 can be disposed at the cleaning end 210 in radial spaced relationship with notches 216 defined therebetween. The projections 214 and notches 216 can be used in conjunction with a plurality of ribs 218, each having a groove 220 therein, to retain the mop element to the operating member 120. The operator end 212 of the handle portion 137 can include a coupling mechanism 224 for releasably securing the covering cap to the handle portion 137. The operating end 212 can include a shoulder 226 for receiving the indexing member 126.

Figure 36:
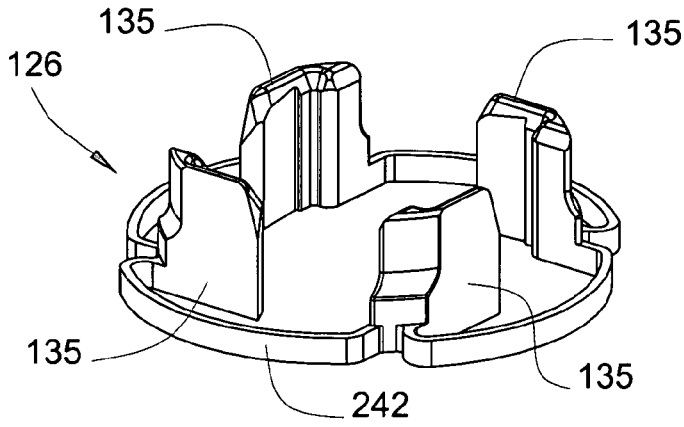
FIG. 36 is a perspective view of an indexing device of the twist mop of FIG. 8.
Figure 37:
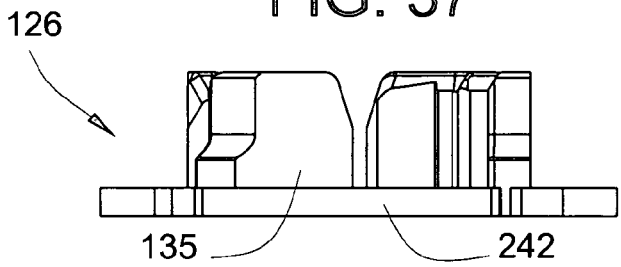
FIG. 37 is an elevational view of the indexing device of FIG. 36.
Figure 38:
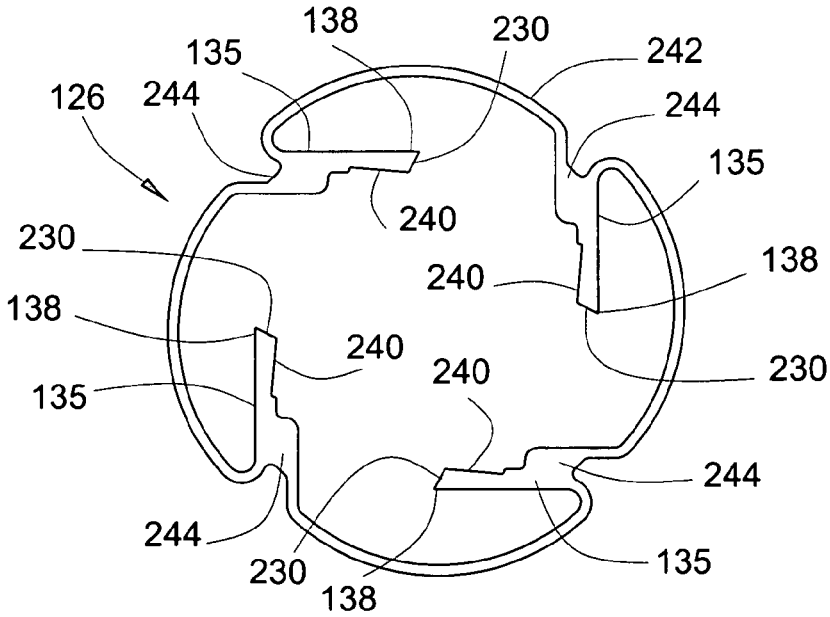
FIG. 38 is a top plan view of the indexing device of FIG. 36.
Figure 39:
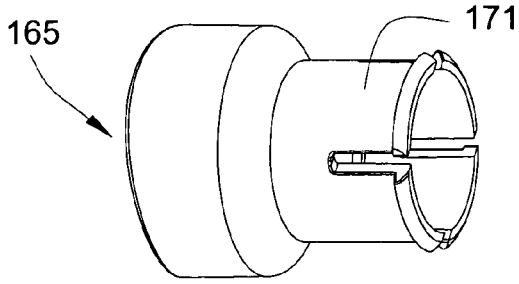
FIG. 39 is a perspective view of a covering cap of the twist mop of FIG. 8.
Figure 40:
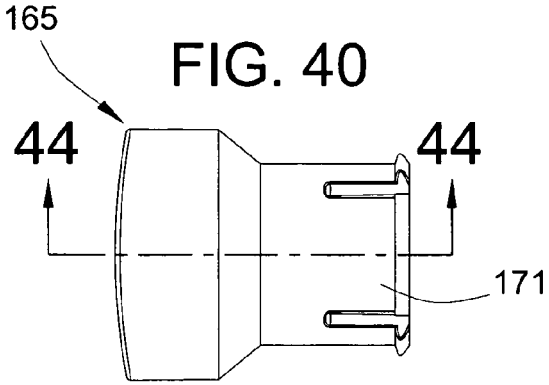
FIG. 40 is a front elevational view of the covering cap of FIG. 39.
Figure 42:
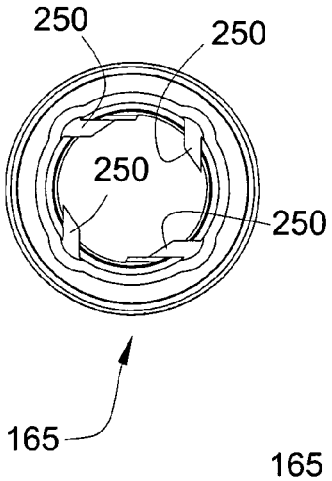
FIG. 42 is a bottom plan view of the covering cap of FIG. 39.
Figure 41:
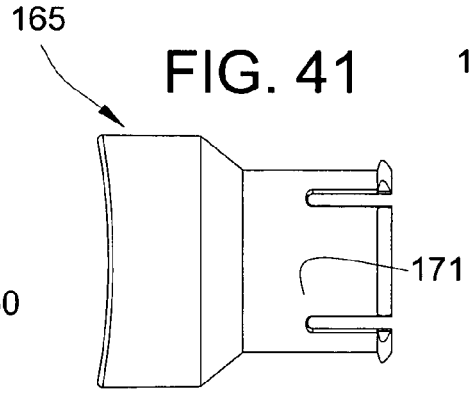
FIG. 41 is a side elevational view of the covering cap of FIG. 39.
Figure 43:
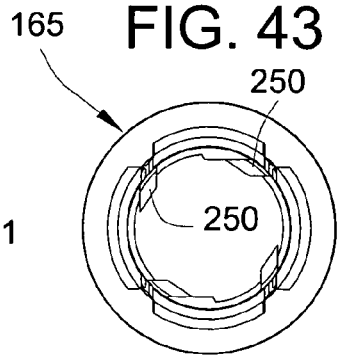
FIG. 43 is a top plan view of the covering cap of FIG. 39.
Figure 44:
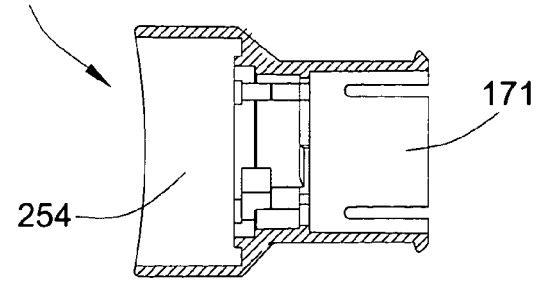
FIG. 44 is a cross-sectional view of the covering cap of FIG. 39 taken along line 44-44 in FIG. 40.
Figure 45:
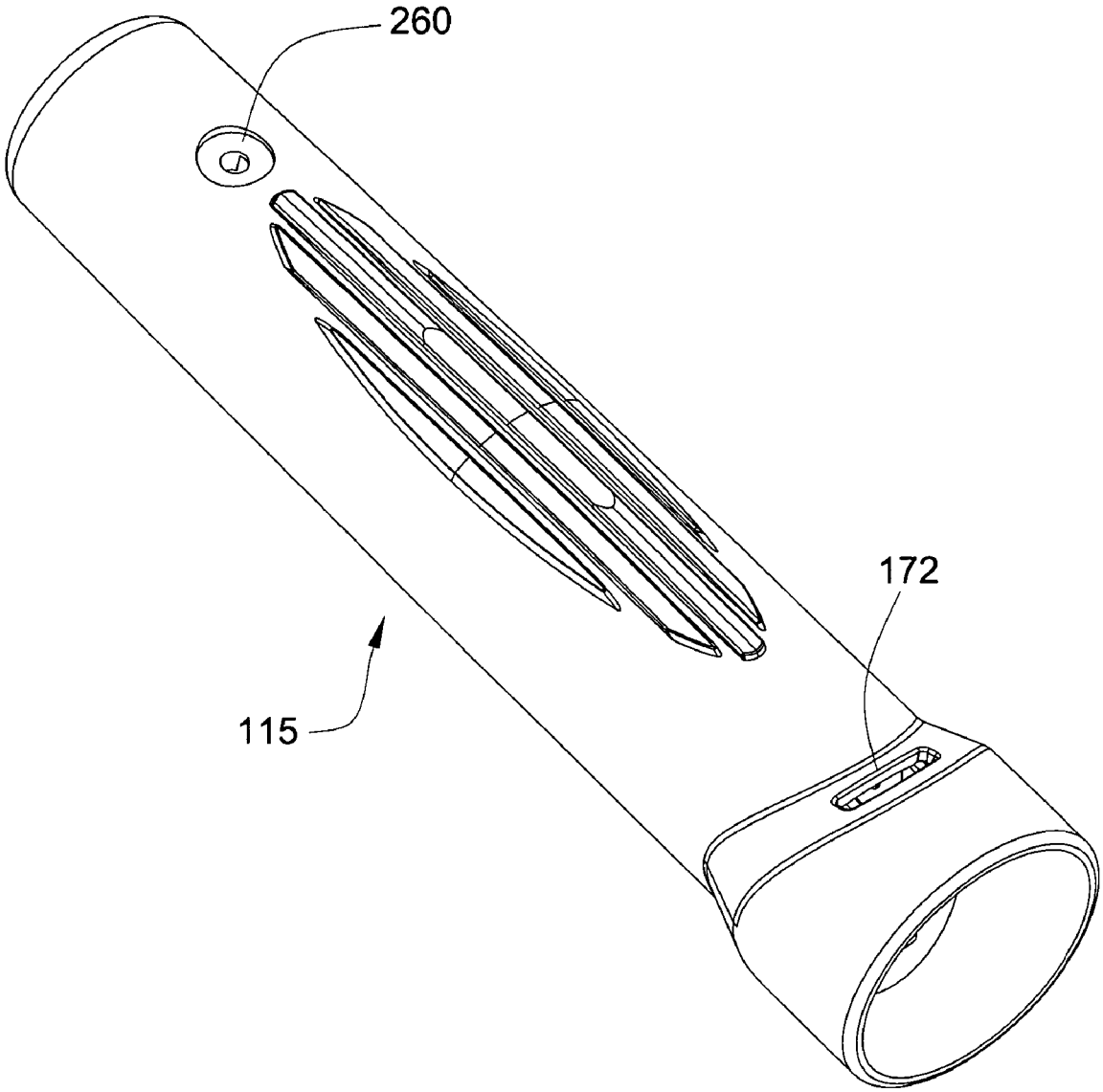
FIG. 45 is a perspective view of the gripping element of the twist mop of FIG. 8.
Figure 46:
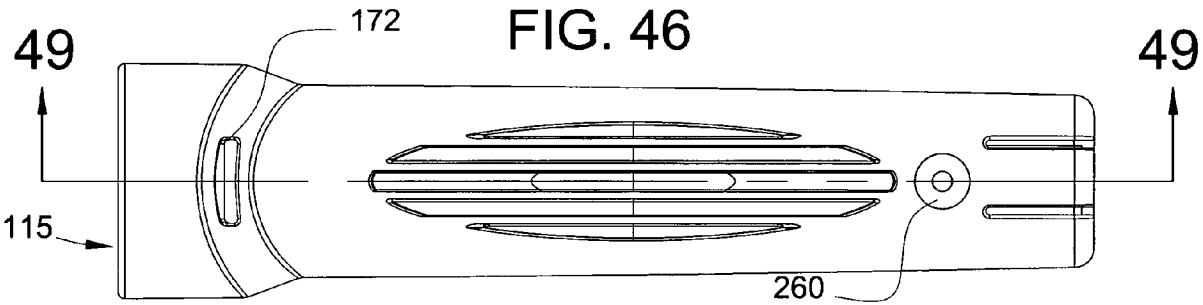
FIG. 46 is a front elevational view of the gripping element of FIG. 45.
Figure 47:
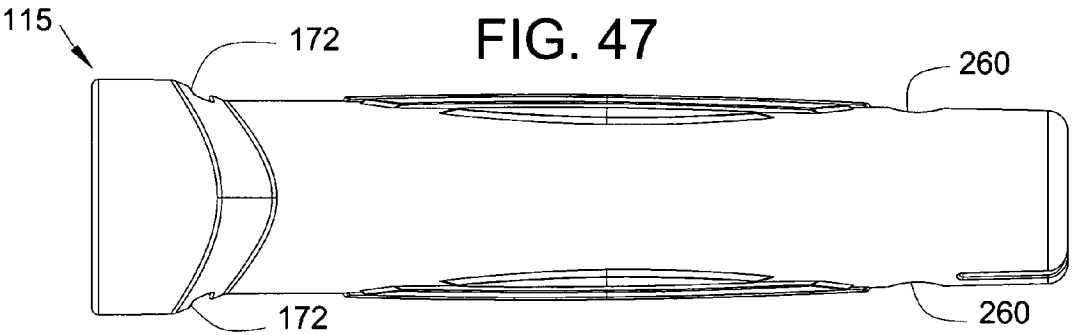
FIG. 47 is a side elevational view of the gripping element of FIG. 45.
Figure 49:
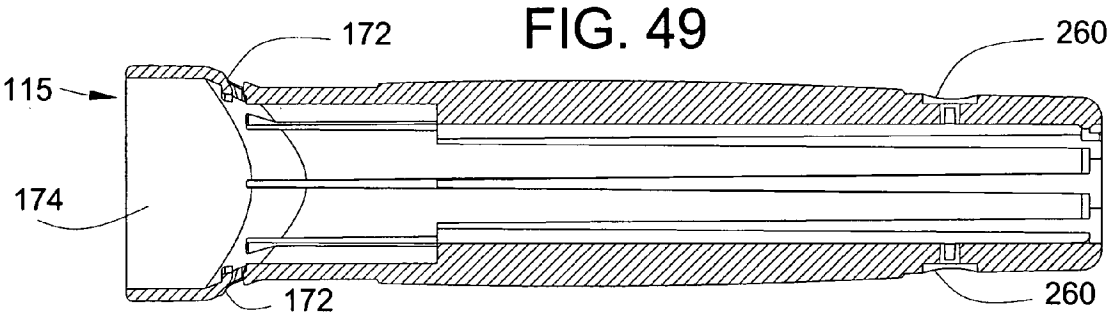
FIG. 49 is a cross-sectional view of the gripping element of FIG. 45 taken along line 49-49 in FIG. 46.
Figure 48:
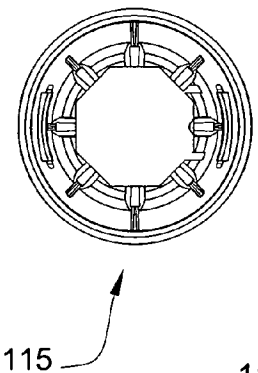
FIG. 48 is a bottom plan view of the gripping element of FIG. 45.

Referring to FIGS. 36-38, the indexing member 126 is shown. The indexing member 126 includes four indexing arms 135. Each arm 135 is the same. The indexing arms 135 are disposed in radial spaced relationship with respect to each other with the indexing arms being rotated approximately 90° with respect to each adjacent indexing arm. Each indexing arm 135 includes a chamfer 230 at the distal end 138 thereof. Each indexing arm 135 includes a generally planar bearing portion 240. The indexing arms 135 are joined tog ether by a support 242 which can be resiliently flexible to allow each arm to pivot about its base 244.

Referring to FIGS. 39-44, the covering cap 165 is shown. The covering cap can include tabs 250 that generally correspond to the openings of the handle portion through which the indexing arms extend. The tabs 250 can act to capture the indexing member between the covering cap 165 and the shoulder of the handle portion. The covering cap 165 include includes four fingers 171 for retentive engagement with the grip element. The covering cap includes a chamber 254 for receiving the operator end of the handle portion and the indexing member.

Referring to FIGS. 45-49, the grip element 115 is shown. The grip element can include a docking chamber 174 for receiving the finger of the covering cap to allow for selective releasable axial retention of the operating member with respect to the grip element 115. The grip element 115 can include a pair of holes 260 for receiving a fastener, such as a rivet, therethrough for securing the grip element 115 to the shaft. The slots 172 are disposed on opposing sides of the grip element 115.

Figure 50:
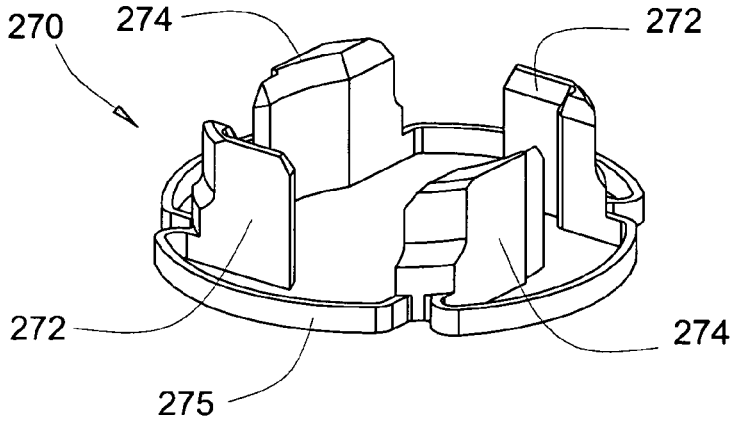
FIG. 50 is a perspective view of another embodiment of an indexing member useful in connection with the present invention.
Figure 51:
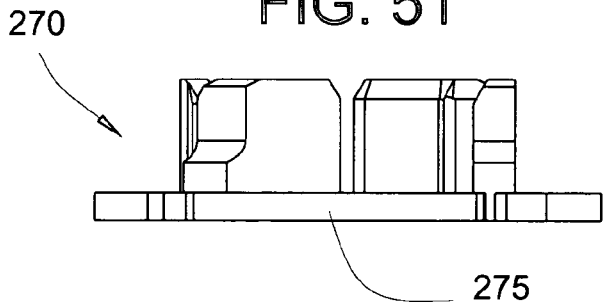
FIG. 51 is an elevational view of the indexing member of FIG. 50.
Figure 52:
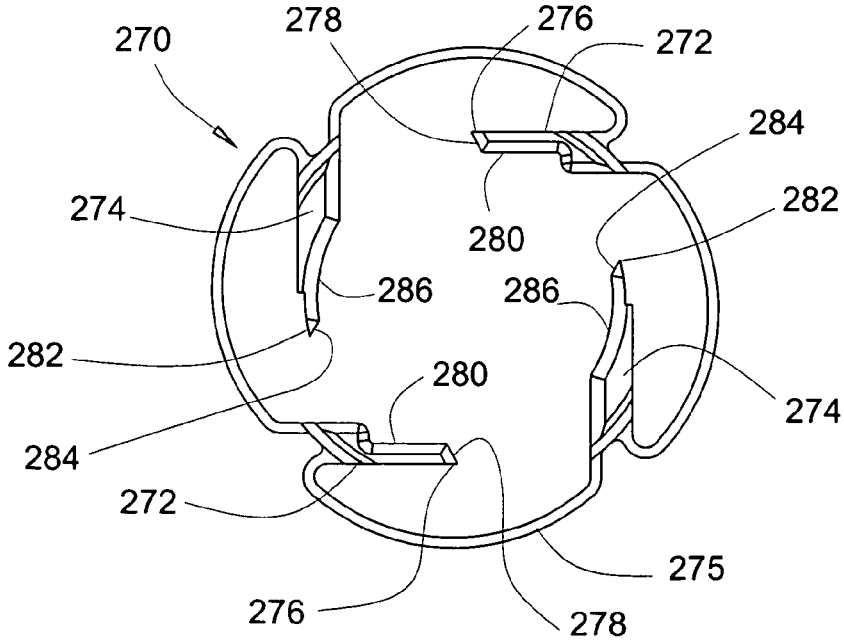
FIG. 52 is a top plan view of the indexing member of FIG. 50.

Referring to FIGS. 50-52, another embodiment of an indexing member 270 is shown. The indexing member 270 can be used with a shaft having a wringing section with a rectangular, preferably square, cross section. The indexing member 270 include a pair of first indexing arms 272 and a pair of second indexing arms 274 connected together via a support 275. The first and second indexing arms are disposed in alternating, spaced radial relationship with respect to each other. The first indexing arms 272 each include a distal end 276 having a chamfer 278 and a generally planar bearing surface 280. The second indexing arms 274 each include a distal end 282 having a chamfer 284 and a generally curved bearing surface 286.

Figure 53:
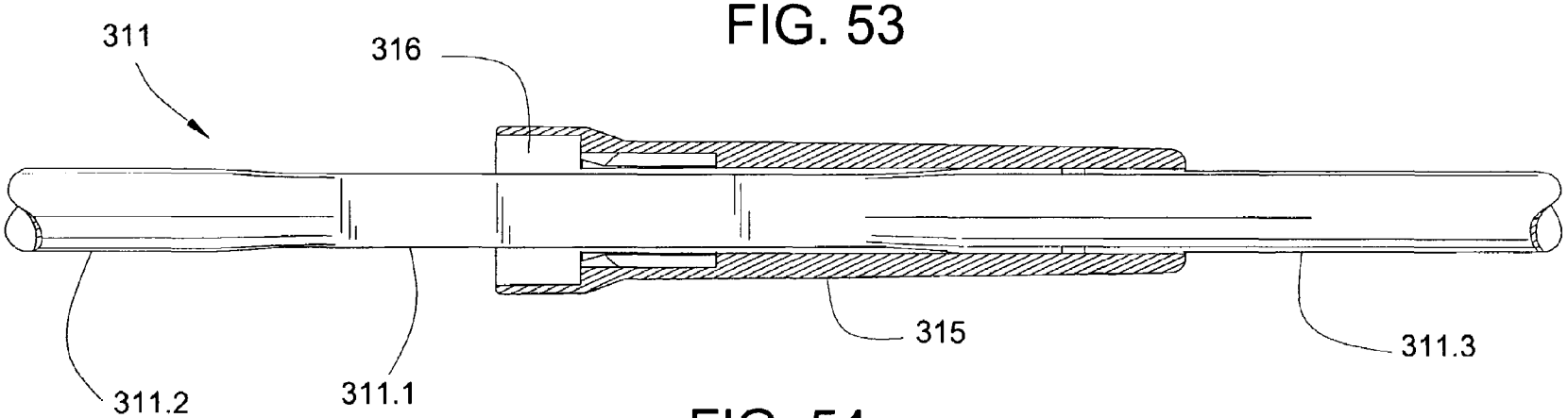
FIG. 53 is a partial elevational view of another embodiment of a shaft useful in connection with the present invention and a grip element mounted thereto.

Referring to FIG. 53, another embodiment of a shaft 311 is shown. The shaft 311 can be used in conjunction with the indexing member 270 shown in FIG. 50. The shaft 311 includes a wringing section 311.1, a mopping section 311.2, and a gripping section 311.3. The gripping and mopping sections 311.3, 311.2 both have a generally circular cross-section. The wringing section 311.1 has a generally rectangular cross-section that is square-shaped in this embodiment. The wringing section 311.1 is disposed in relation to a grip element 315 such that the docking chamber 316 of the grip element is located to allow an indexing member, disposed in an operating member similar to one shown in FIG. 8, be engageable with the wringing section 311.1 when the operating member is docked in the grip element 315.

Figure 54:
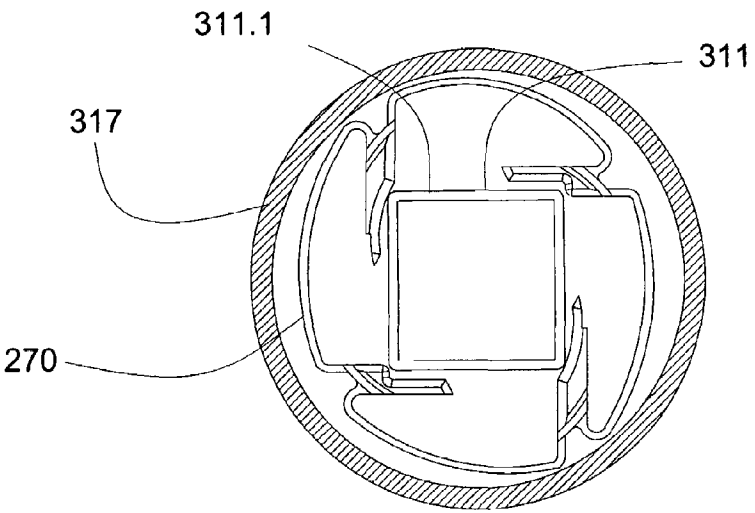
FIG. 54 is a somewhat schematic plan view of the indexing member of FIG. 50 disposed in an operating member around the shaft of FIG. 53.

Referring to FIG. 54, the indexing member 270 is shown somewhat schematically in an operating member 317 in proximal relation with the wringing section 311.1 of the shaft 311. The operator handle has been omitted in FIG. 54. In use, the operating member can include structure to retain the indexing member 270 similar to what has been previously described herein.

It is preferable for the shaft to comprise steel, for the operating member to comprise plastic, in particular polypropylene (PP) and for the indexing arms likewise to comprise plastic, in particular polyoxymethylene (POM).

In the case of a self-wringing mop, it is not necessary according to the invention for the index arm and the indexing surface to have a form-fitting connection. This gives a high degree of design flexibility.

The ability of the operating member to rotate freely in the mopping section 11.2 can be achieved by providing the shaft with a cross-sectional diameter that is smaller than the internal diameter of the operating member. In one embodiment, the shaft has a round cross-section in this region. In particular when the shaft is steel, a shaft with a polygonal wringing section and a round, mopping section can be produced in one monolithic piece, for example by means of roll-forming, in which case the initially round shaft has a polygonal cross-section integrally formed thereon. The wringing section alternatively may be formed on a separate sleeve disposed over the shaft. In other embodiments, the shaft can have more than two sections. That is, the shaft can include one or more sections in addition to the mopping section and the wringing section.

Other components which can be suitable for use with the twist mop are shown and described in U.S. Pat. Nos. 6,112,358 and 5,850,658.

Thus, it is seen that the foregoing general object has been satisfied. A twist mop prepared in accordance with the invention may be easily wrung by an operator. Moreover, the rotation of the operating member may be advanced in small angular increments, and the indexing device will prevent the operating member from rotating in a direction opposite the desired direction of rotation. Thus, the exertion of a great amount of strength is not required to wring the mop. In addition, the ropes of the mop element may be prepared in sufficient length to provide a satisfactory mop element area.

All references, including publications, patent applications, and patents, cited herein are hereby incorporated by reference The use of the terms "a" and "an" and "the" and similar referents in the context of describing the invention is to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., "such as") provided herein is intended to illuminate the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A mop comprising:

a shaft having an operator end and a cleaning end;

an operating member disposed on said shaft and being movable axially along at least a portion of said shaft and being rotatable with respect to said shaft;

a mop element comprising a liquid absorbent material, said mop element having a first portion connected to said operating member and a second portion connected to said cleaning end of said shaft, whereby liquid is expellable from said mop element when said operating member is rotated relative to said shaft;

wherein said shaft has an indexing surface disposed over an axial portion thereof; said indexing surface having a cross section substantially in the shape of a regular polygon;

wherein said operating member includes at least one indexing arm engaging said indexing surface when said operating member is proximal said indexing surface, said indexing arm rotationally retaining said operating member with respect to said shaft to thereby restrict relative rotation of said shaft and operating member in one direction; and wherein said operating member includes an index end and a socket in said index end receiving a support, said support having at least one indexing arm, said support having a detent engaging a notch in said operating member to inhibit relative rotation of said support and said operating member, said socket including a lip engaging said support for inhibiting relative axial movement of said operating member and said support.

2. The mop according to claim 1, said indexing surface being monolithic with said shaft.

3. The mop according to claim 1, said indexing surface being disposed on a sleeve disposed over said shaft.

4. The mop according to claim 1, said indexing surface having a substantially octagonal cross section.

5. The mop according to claim 1, said operating member having a slot disposed proximal said index end, said indexing arm being disposed within said slot.

6. The mop according to claim 1, said support including four indexing arms.

* * * * *